US011521502B2

(12) United States Patent
Ali et al.

(10) Patent No.: US 11,521,502 B2
(45) Date of Patent: Dec. 6, 2022

(54) PARALLEL DECONFLICTION PROCESSING OF UNMANNED AERIAL VEHICLES

(71) Applicant: SKYGRID, LLC, Austin, TX (US)

(72) Inventors: Syed Mohammad Ali, Leander, TX (US); Lowell L. Duke, Austin, TX (US); Zehra Akbar, Leander, TX (US); Syed Mohammad Amir Husain, Georgetown, TX (US)

(73) Assignee: SKYGRID, LLC, Austin, TX (US)

( * ) Notice: Subject to any disclaimer, the term of this patent is extended or adjusted under 35 U.S.C. 154(b) by 0 days.

(21) Appl. No.: 17/009,926

(22) Filed: Sep. 2, 2020

(65) Prior Publication Data

US 2022/0351627 A1 Nov. 3, 2022

Related U.S. Application Data

(60) Provisional application No. 62/935,217, filed on Nov. 14, 2019, provisional application No. 62/894,887, filed on Sep. 2, 2019.

(51) Int. Cl.
*G08G 5/00* (2006.01)
*G08G 5/04* (2006.01)

(52) U.S. Cl.
CPC ..... *G08G 5/0069* (2013.01); *G08G 5/0013* (2013.01); *G08G 5/0026* (2013.01); *G08G 5/0039* (2013.01); *G08G 5/0043* (2013.01); *G08G 5/0052* (2013.01); *G08G 5/0082* (2013.01); *G08G 5/045* (2013.01)

(58) Field of Classification Search
CPC .. G08G 5/0013; G08G 5/0026; G08G 5/0039; G08G 5/0043; G08G 5/0052; G08G 5/0069; G08G 5/045
See application file for complete search history.

(56) References Cited

U.S. PATENT DOCUMENTS

| | | | | |
|---|---|---|---|---|
| 9,990,854 | B1 | 6/2018 | Elmasry et al. | |
| 2010/0121575 | A1 | 5/2010 | Aldridge et al. | |
| 2018/0218620 | A1* | 8/2018 | Kalyan | G08G 5/0013 |
| 2019/0043368 | A1 | 2/2019 | Priest | |
| 2019/0228665 | A1 | 7/2019 | Bosworth | |
| 2021/0020052 | A1* | 1/2021 | Nagai | G08G 5/0013 |

OTHER PUBLICATIONS

International Search Report and Written Opinion, PCT/US2020/048895, dated Dec. 18, 2020, 10 pages.

* cited by examiner

*Primary Examiner* — Andrew W Bee

(57) ABSTRACT

In a particular embodiment, parallel deconfliction processing of unmanned aerial vehicles (UAVs) is disclosed that includes a UAV control system partitioning the airspace over a geographic region into a plurality of airspace regions. In this example embodiment, the UAV control system includes a plurality of deconfliction controllers. For each deconfliction controller in the plurality of deconfliction controllers, the UAV control system assigns to the deconfliction controller, one or more airspace regions of the plurality of airspace regions. The UAV control system also inputs, in parallel, flight path data for a plurality of unmanned aerial vehicles (UAVs) to the plurality of deconfliction controllers. This embodiment also includes processing, in parallel by the plurality of deconfliction controllers, the flight path data to identify a flight conflict between two or more UAVs. Each deconfliction controller outputs a deconfliction result for each airspace region.

20 Claims, 17 Drawing Sheets

PARALLEL DECONFLICTION PROCESSING OF UNMANNED AERIAL VEHICLES

CROSS-REFERENCE TO RELATED APPLICATIONS

This application is a non-provisional application for patent entitled to a filing date and claiming the benefit of earlier-filed U.S. Provisional Patent Application Ser. No. 62/894,887, filed Sep. 2, 2019, and U.S. Provisional Patent Application Ser. No. 62/935,217, filed Nov. 14, 2019.

BACKGROUND

An Unmanned Aerial Vehicle (UAV) is a term used to describe an aircraft with no pilot on-board the aircraft. The use of UAVs is growing in an unprecedented rate, and it is envisioned that UAVs will become commonly used for package delivery and passenger air taxis. However, as UAVs become more prevalent in the airspace, there is a need to regulate air traffic and ensure the safe navigation of the UAVs.

The Unmanned Aircraft System Traffic Management (UTM) is an initiative sponsored by the Federal Aviation Administration (FAA) to enable multiple beyond visual line-of-sight drone operations at low altitudes (under 400 feet above ground level (AGL)) in airspace where FAA air traffic services are not provided. However, a framework that extends beyond the 400 feet AGL limit is needed. For example, unmanned aircraft that would be used by package delivery services and air taxis may need to travel at altitudes above 400 feet. Such a framework requires technology that will allow the FAA to safely regulate unmanned aircraft.

An important aspect of UAV navigation safety is flight path deconfliction and collision avoidance. As the number of UAVs in the skies increases, so will the difficulty in preventing conflicts among their flight paths, particularly because the flight path of each UAV may change according to the various impediments to navigation (e.g., weather, structures, collision avoidance) that each UAV faces. That is, a change in the flight path of one UAV may have a "butterfly effect" among UAVs in the sky. However, collecting and processing data about UAV flight paths, and resolving conflicting flight paths for collision avoidance, is both a complex and computationally intensive problem.

SUMMARY

In a particular embodiment, parallel deconfliction processing of unmanned aerial vehicles (UAVs) is disclosed that includes a UAV control system partitioning the airspace over a geographic region into a plurality of airspace regions. In this example embodiment, the UAV control system includes a plurality of deconfliction controllers. For each deconfliction controller in the plurality of deconfliction controllers, the UAV control system assigns to the deconfliction controller, one or more airspace regions of the plurality of airspace regions. The UAV control system also inputs, in parallel, flight path data for a plurality of unmanned aerial vehicles (UAVs) to the plurality of deconfliction controllers. This embodiment also includes processing, in parallel by the plurality of deconfliction controllers, the flight path data to identify a flight conflict between two or more UAVs. Each deconfliction controller outputs a deconfliction result for each airspace region.

In a particular embodiment, flight path deconfliction among unmanned aerial vehicles is disclosed. Flight path data is received for an unmanned aerial vehicle (UAV) is received by a UAV control system, wherein the flight path data indicates a flight path that traverses a geographic cell assigned to a particular deconfliction module of the UAV control system. The geographic cell may be one of a plurality of geographic cells that partition the airspace over a geographic region, wherein each respective geographic cell is assigned to a respective deconfliction module of the UAV control system. The deconfliction module determines whether the first flight path conflicts with at least one other flight path of at least one other UAV that also traverses the geographic cell. A UAV control system provides, in dependence upon the determination, navigation instructions for one or more of the UAVs.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION

Figure 1:
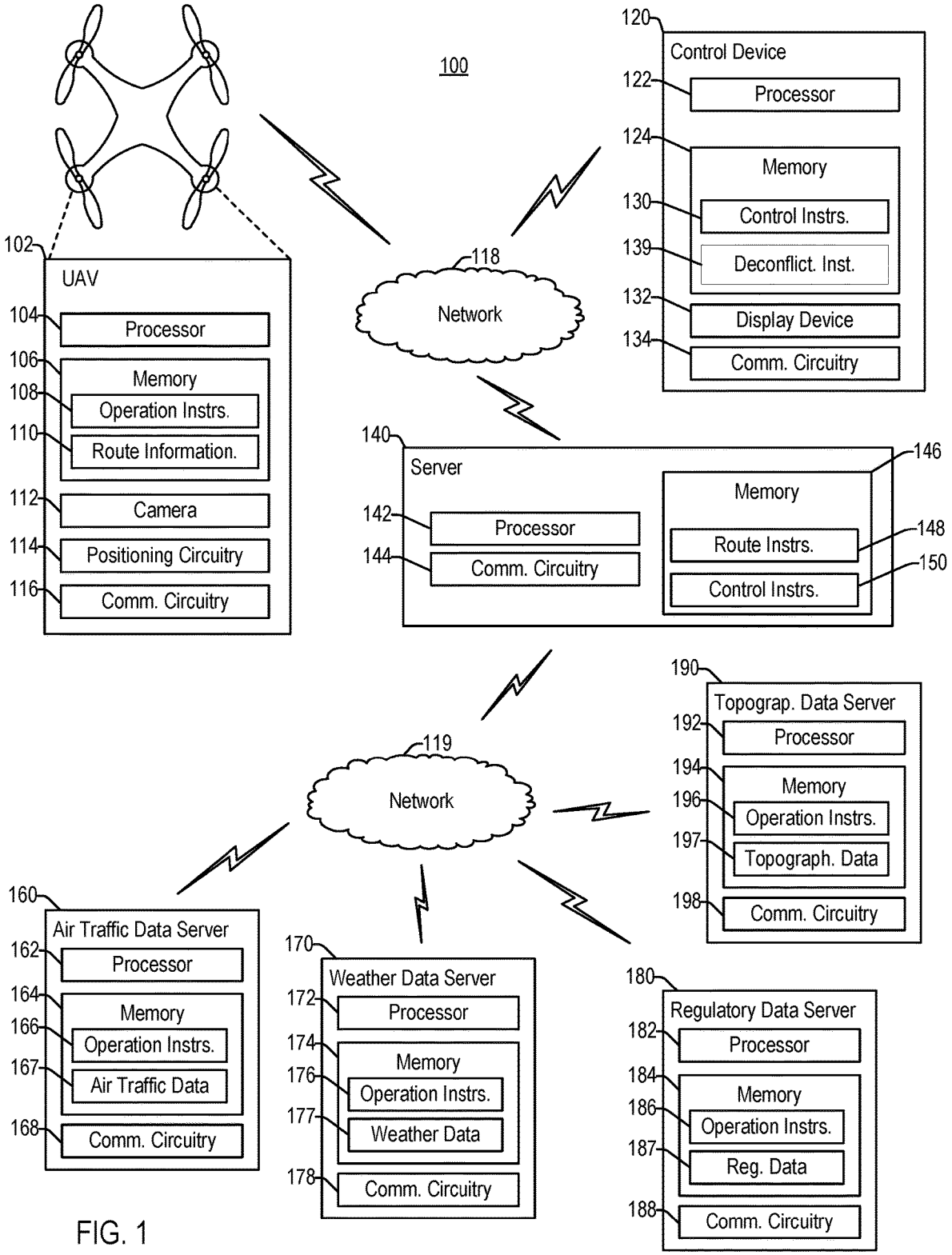
FIG. 1 is a block diagram illustrating a particular implementation of a system for flight path deconfliction among unmanned aerial vehicles.

Particular aspects of the present disclosure are described below with reference to the drawings. In the description, common features are designated by common reference numbers throughout the drawings. As used herein, various terminology is used for the purpose of describing particular implementations only and is not intended to be limiting. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

In the present disclosure, terms such as "determining," "calculating," "estimating," "shifting," "adjusting," etc. may be used to describe how one or more operations are performed. It should be noted that such terms are not to be construed as limiting and other techniques may be utilized to perform similar operations. Additionally, as referred to herein, "generating," "calculating," "estimating," "using," "selecting," "accessing," and "determining" may be used interchangeably. For example, "generating," "calculating," "estimating," or "determining" a parameter (or a signal) may refer to actively generating, estimating, calculating, or determining the parameter (or the signal) or may refer to using, selecting, or accessing the parameter (or signal) that is already generated, such as by another component or device.

As used herein, "coupled" may include "communicatively coupled," "electrically coupled," or "physically coupled," and may also (or alternatively) include any combinations thereof. Two devices (or components) may be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled may be included in the same device or in different devices and may be connected via electronics, one or more connectors, or inductive coupling, as illustrative, non-limiting examples. In some implementations, two devices (or components) that are communicatively coupled, such as in electrical communication, may send and receive electrical signals (digital signals or analog signals) directly or indirectly, such as via one or more wires, buses, networks, etc. As used herein, "directly coupled" may include two devices that are coupled (e.g., communicatively coupled, electrically coupled, or physically coupled) without intervening components.

Exemplary methods, apparatuses, and computer program products for route planning for an UAV in accordance with the present invention are described with reference to the accompanying drawings, beginning with FIG. 1. FIG. 1 sets forth a diagram of a system (100) configured for route planning for an UAV according to embodiments of the present disclosure. The system (100) of FIG. 1 includes an unmanned aerial vehicle (UAV) (102), a control device (120), a server (140), an air traffic data server (160), a weather data server (170), a regulatory data server (180), and a topographical data server (190).

A UAV, commonly known as a drone, is a type of powered aerial vehicle that does not carry a human operator and uses aerodynamic forces to provide vehicle lift. UAVs are a component of an unmanned aircraft system (UAS), which typically include at least a UAV, a control device, and a system of communications between the two. The flight of a UAV may operate with various levels of autonomy including under remote control by a human operator or autonomously by onboard or ground computers. Although a UAV may not include a human operator pilot, some UAVs, such passenger drones (drone taxi, flying taxi, or pilotless helicopter) carry human passengers.

For ease of illustration, the UAV (102) is illustrated as one type of drone. However, any type of UAV may be used in accordance with embodiments of the present disclosure and unless otherwise noted, any reference to a UAV in this application is meant to encompass all types of UAVs. Readers of skill in the art will realize that the type of drone that is selected for a particular mission or excursion may depend on many factors, including but not limited to the type of payload that the UAV is required to carry, the distance that the UAV must travel to complete its assignment, and the types of terrain and obstacles that are anticipated during the assignment.

In FIG. 1, the UAV (102) includes a processor (104) coupled to a memory (106), a camera (112), positioning circuitry (114), and communication circuitry (116). The communication circuitry (116) includes a transmitter and a receiver or a combination thereof (e.g., a transceiver). In a particular implementation, the communication circuitry (116) (or the processor (104)) is configured to encrypt outgoing message(s) using a private key associated with the UAV (102) and to decrypt incoming message(s) using a public key of a device (e.g., the control device (120) or the server (140)) that sent the incoming message(s). Thus, in this implementation, communications between the UAV (102), the control device (120), and the server (140) are secure and trustworthy (e.g., authenticated).

The camera (112) is configured to capture image(s), video, or both, and can be used as part of a computer vision system. For example, the camera (112) may capture images or video and provide the video or images to a pilot of the UAV (102) to aid with navigation. Additionally, or alternatively, the camera (112) may be configured to capture images or video to be used by the processor (104) during performance of one or more operations, such as a landing operation, a takeoff operation, or object/collision avoidance, as non-limiting examples. Although a single camera (112) is shown in FIG. 1, in alternative implementations more and/or different sensors may be used (e.g., infrared, LIDAR, SONAR, etc.).

The positioning circuitry (114) is configured to determine a position of the UAV (102) before, during, and/or after flight. For example, the positioning circuitry (114) may include a global positioning system (GPS) interface or sensor that determines GPS coordinates of the UAV (102). The positioning circuitry (114) may also include gyroscope(s), accelerometer(s), pressure sensor(s), other sensors, or a combination thereof, that may be used to determine the position of the UAV (102).

The processor (104) is configured to execute instructions stored in and retrieved from the memory (106) to perform various operations. For example, the instructions include operation instructions (108) that include instructions or code that cause the UAV (102) to perform flight control operations. The flight control operations may include any operations associated with causing the UAV to fly from an origin to a destination. For example, the flight control operations may include operations to cause the UAV to fly along a designated route (e.g., based on route information (110), as further described herein), to perform operations based on control data received from one or more control devices, to take off, land, hover, change altitude, change pitch/yaw/roll angles, or any other flight-related operations. The UAV (102) may include one or more actuators, such as one or more flight control actuators, one or more thrust actuators, etc., and execution of the operation instructions (108) may cause the processor (104) to control the one or more actuators to perform the flight control operations. The one or more actuators may include one or more electrical actuators, one or more magnetic actuators, one or more hydraulic actuators, one or more pneumatic actuators, one or more other actuators, or a combination thereof.

The route information (110) may indicate a flight path for the UAV (102) to follow. For example, the route information (110) may specify a starting point (e.g., an origin) and an ending point (e.g., a destination) for the UAV (102). Additionally, the route information may also indicate a plurality of waypoints, zones, areas, regions between the starting point and the ending point.

The route information (110) may also indicate a corresponding set of control devices for various points, zones, regions, areas of the flight path. The indicated sets of control devices may be associated with a pilot (and optionally one or more backup pilots) assigned to have control over the UAV (102) while the UAV (102) is in each zone. The route information (110) may also indicate time periods during which the UAV is scheduled to be in each of the zones (and thus time periods assigned to each pilot or set of pilots).

The control device (120) includes a processor (122) coupled to a memory (124), a display device (132), and communication circuitry (134). The display device (132) may be a liquid crystal display (LCD) screen, a touch screen, another type of display device, or a combination thereof. The communication circuitry (134) includes a transmitter and a receiver or a combination thereof (e.g., a transceiver). In a particular implementation, the communication circuitry (134) (or the processor (122)) is configured to encrypt outgoing message(s) using a private key associated with the control device (120) and to decrypt incoming message(s) using a public key of a device (e.g., the UAV (102) or the server (140)) that sent the incoming message(s). Thus, in this implementation, communication between the UAV (102), the control device (120), and the server (140) are secure and trustworthy (e.g., authenticated).

The processor (122) is configured to execute instructions from the memory (124) to perform various operations. The instructions also include control instructions (130) that include instructions or code that cause the control device (120) to generate control data to transmit to the UAV (102) to enable the control device (120) to control one or more operations of the UAV (102) during a particular time period, as further described herein. The instructions also include deconfliction instructions (139) that include receiving flight path data for a first unmanned aerial vehicle (UAV), wherein the flight path data indicates a first flight path that traverses a geographic cell assigned to the deconfliction controller; determining, by a deconfliction module, whether the first flight path conflicts with at least one second flight path of at least one second UAV, wherein the at least one second flight path also traverses the geographic cell; and providing, in dependence upon the determination, first navigation instructions for one or more UAVs. The deconfliction instructions (139) are further configured for determining that the first flight path conflicts with the at least one of second flight path and providing, to at least one of the first UAV and the second UAV, rerouting instructions for a rerouted flight path that avoids the conflict. In some embodiments the first UAV and the at least one second UAV are coordinated by a server and the method further comprises transmitting one or more rerouted flight paths to a server. The deconfliction instructions (139) are further configured for receiving a flight path approval request and providing a flight path approval response to the first UAV.

The server (140) includes a processor (142) coupled to a memory (146), and communication circuitry (144). The communication circuitry (144) includes a transmitter and a receiver or a combination thereof (e.g., a transceiver). In a particular implementation, the communication circuitry (144) (or the processor (142)) is configured to encrypt outgoing message(s) using a private key associated with the server (140) and to decrypt incoming message(s) using a public key of a device (e.g., the UAV (102) or the control device (120)) that sent the incoming message(s). Thus, in this implementation, communication between the UAV (102), the control device (120), and the server (140) are secure and trustworthy (e.g., authenticated).

The processor (142) is configured to execute instructions from the memory (146) to perform various operations. The instructions include route instructions (148) comprising computer program instructions for aggregating data from disparate data servers, virtualizing the data in a map, generating a cost model for paths traversed in the map, and autonomously selecting the optimal route for the UAV based on the cost model. For example, the route instructions (148) are configure to partition a map of a region into geographic cells, calculate a cost for each geographic cell, wherein the cost is a sum of a plurality of weighted factors, determine a plurality of flight paths for the UAV from a first location on the map to a second location on the map, wherein each flight path traverses a set of geographic cells, determine a cost for each flight path based on the total cost of the set of geographic cells traversed, and select, in dependence upon the total cost of each flight path, an optimal flight path from the plurality of flight paths. The route instructions (148) are further configured to obtain data from one or more data servers regarding one or more geographic cells, calculate, in dependence upon the received data, an updated cost for each geographic cell traversed by a current flight path, calculate a cost for each geographic cell traversed by at least one alternative flight path from the first location to the second location, determine that at least one alternative flight path has a total cost that is less than the total cost of the current flight path, and select a new optimal flight path from the at least one alternative flight paths. The route instructions (148) may also include instructions for storing the parameters of the selected optimal flight path as route information (110).

For example, the route information may include waypoints marked by GPS coordinates, arrival times for waypoints, pilot assignments. The server (140) may be configured to transmit the route information (110) to the UAV (102).

The instructions may also include control instructions (150) that include instructions or code that cause the server (140) to generate control data to transmit to the UAV (102) to enable the server (140) to control one or more operations of the UAV (102) during a particular time period, as further described herein.

The UAV (102), the control device (120), and server (140) are communicatively coupled via a network (118). For example, the network (118) may include a satellite network or another type of network that enables wireless communication between the UAV (102), the control device (120), and the server (140). In an alternative implementation, the control device (120), the server (140) communicate with the UAV (102) via separate networks (e.g., separate short range networks.

In some situations, minimal (or no) manual control of the UAV (102) may be performed, and the UAV (102) may travel from the origin to the destination without incident. However, in some situations, one or more pilots may control the UAV (102) during a time period, such as to perform object avoidance or to compensate for an improper UAV operation. In some situations, the UAV (102) may be temporarily stopped, such as during an emergency condition, for recharging, for refueling, to avoid adverse weather conditions, responsive to one or more status indicators from the UAV (102), etc. In some implementations, due to the unscheduled stop, the route information (110) may be updated (e.g., via a subsequent blockchain entry, as further described herein) by route instructions (148) executing on the UAV (102), the control device (120), or the server (140)). The updated route information may include updated waypoints, updated time periods, and updated pilot assignments.

In a particular implementation, the route information is exchanged using a blockchain data structure. The blockchain data structure is shared in a distributed manner across a plurality of devices of the system (100), such as the UAV (102), the control device (120), the server (140), and any other control devices or UAVs in the system (100). In a particular implementation, each of the devices of the system (100) stores an instance of the blockchain data structure in a local memory of the respective device. In other implementations, each of the devices of the system (100) stores a portion of the shared blockchain data structure and each portion is replicated across multiple of the devices of the system (100) in a manner that maintains security of the shared blockchain data structure as a public (i.e., available to other devices) and incorruptible (or tamper evident) ledger.

Figure 3:
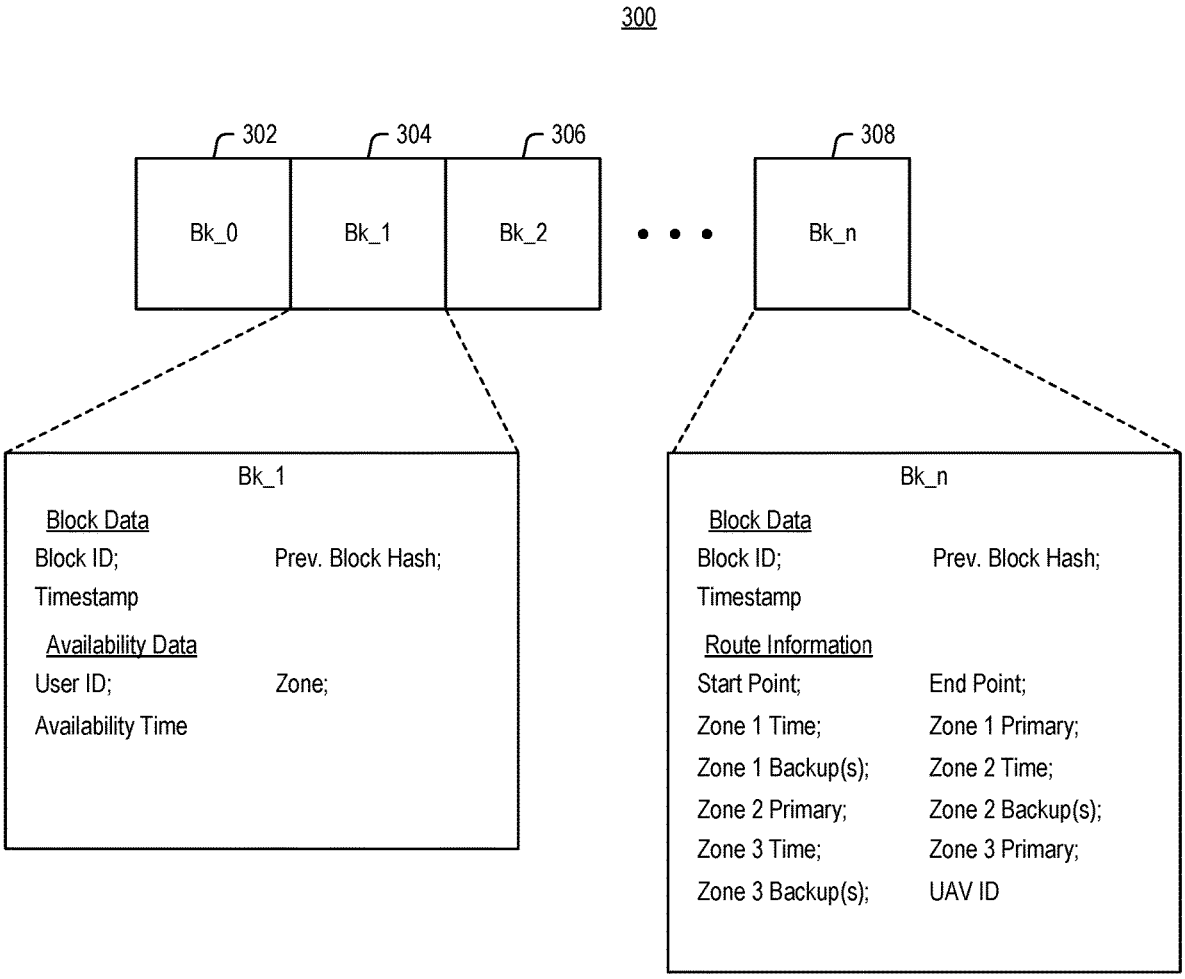
FIG. 3 is a block diagram illustrating a particular implementation of blockchain-based operations used by the systems of FIGS. 1-2.

The blockchain data structure may include, among other things, route information associated with the UAV (102). For example, the route information (110) may be used to generate blocks of the blockchain data structure. A sample blockchain data structure (300) is illustrated in FIG. 3. Each block of the blockchain data structure (300) includes block data and other data, such as availability data or route data.

The block data of each block includes information that identifies the block (e.g., a block ID) and enables the devices of the system (100) to confirm the integrity of the blockchain data structure (300). For example, the block data also includes a timestamp and a previous block hash. The timestamp indicates a time that the block was created. The block ID may include or correspond to a result of a hash function (e.g., a SHA256 hash function, a RIPEMD hash function, etc.) based on the other information (e.g., the availability data or the route data) in the block and the previous block hash (e.g., the block ID of the previous block). For example, in FIG. 3, the blockchain data structure (300) includes an initial block (Bk_0) (302) and several subsequent blocks, including a block Bk_1 (304), a block Bk_2 (306), and a block Bk_n (308). The initial block Bk_0 (302) includes an initial set of availability data or route data, a timestamp, and a hash value (e.g., a block ID) based on the initial set of availability data or route data. The block Bk_1 (304) also includes a hash value based on the other data of the block Bk_1 (304) and the previous hash value from the initial block Bk_0 (302). Similarly, the block Bk_2 (306) other data and a hash value based on the other data of the block Bk_2 (306) and the previous hash value from the block Bk_1 (304). The block Bk_n (308) includes other data and a hash value based on the other data of the block Bk_n (308) and the hash value from the immediately prior block (e.g., a block Bk_n−1). This chained arrangement of hash values enables each block to be validated with respect to the entire blockchain; thus, tampering with or modifying values in any block of the blockchain is evident by calculating and verifying the hash value of the final block in the block chain. Accordingly, the blockchain acts as a tamper-evident public ledger of availability data and route data for the system (100).

In addition to the block data, each block of the blockchain data structure (300) includes availability data or route data. For example, the block Bk_1 (304) includes availability data that includes a user ID (e.g., an identifier of the mobile device, or the pilot, that generated the availability data), a zone (e.g., a zone at which the pilot will be available), and an availability time (e.g., a time period the pilot is available at the zone to pilot a UAV). As another example, the block Bk_n (308) includes route information that includes a UAV ID, a start point, an end point, waypoints, GPS coordinates, zone markings, time periods, primary pilot assignments, and backup pilot assignments for each zone associated with the route.

Referring back to FIG. 1, in a particular embodiment, the server (140) includes software that is configured to receive telemetry information from an airborne UAV and track the UAV's progress and status. The server (140) is also configured to transmit in-flight commands to the UAV. Operation of the control device and the server may be carried out by some combination of a human operator and autonomous software (e.g., artificial intelligence (AI) software that is able to perform some or all of the operational functions of a typical human operator pilot).

In a particular embodiment, the route instructions (148) cause the server (140) to plan a flight path, generate route information, dynamically reroute the flight path and update the route information based on data aggregated from a plurality of data servers. For example, the server (140) may receive air traffic data (167) over the network (119) from the air traffic data server (160), weather data (177) from the weather data server (170), regulatory data (187) from the regulatory data server (180), and topographical data (197) from the topographic data server (190). It will be recognized by those of skill in the art that other data servers useful in-flight path planning of a UAV may also provide data to the server (140) over the network (101) or through direct communication with the server (140).

The air traffic data server (160) may include a processor (162), memory (164), and communication circuitry (168). The memory (164) of the air traffic data server (160) may include operating instructions (166) that when executed by the processor (162) cause the processor to provide the air traffic data (167) about the flight paths of other aircraft in a region, including those of other UAVs. The air traffic data may also include real-time radar data indicating the positions of other aircraft, including other UAVs, in the immediate vicinity or in the flight path of a particular UAV. Air traffic data servers may be, for example, radar stations, airport air traffic control systems, the FAA, UAV control systems, and so on.

The weather data server (170) may include a processor (172), memory (174), and communication circuitry (178). The memory (174) of the weather data server (170) may include operating instructions (176) that when executed by the processor (172) cause the processor to provide the weather data (177) that indicates information about atmospheric conditions along the UAV's flight path, such as temperature, wind, precipitation, lightening, humidity, atmospheric pressure, and so on. Weather data servers may be, for example, the National Weather Service (NWS), the National Oceanic and Atmospheric Administration (NOAA), local meteorologists, radar stations, other aircraft, and so on.

The regulatory data server (180) may include a processor (182), memory (184), and communication circuitry (188). The memory (184) of the weather data server (180) may include operating instructions (186) that when executed by the processor (182) cause the processor provide the regulatory data (187) that indicates information about laws and regulations governing a particular region of airspace, such as airspace restrictions, municipal and state laws and regulations, permanent and temporary no-fly zones, and so on. Regulatory data servers may include, for example, the FAA, state and local governments, the Department of Defense, and so on.

The topographical data server (190) may include a processor (192), memory (194), and communication circuitry (198). The memory (194) of the topographical data server (190) may include operating instructions (196) that when executed by the processor (192) cause the processor to provide the topographical data that indicates information about terrain, places, structures, transportation, boundaries, hydrography, orthoimagery, land cover, elevation, and so on. Topographic data may be embodied in, for example, digital elevation model data, digital line graphs, and digital raster graphics. Topographic data servers may include, for example, the United States Geological Survey or other geographic information systems (GISs).

In some embodiments, the server (140) may aggregate data from the data servers (160, 170, 180, 190) using application program interfaces (APIs), syndicated feeds and eXtensible Markup Language (XML), natural language processing, JavaScript Object Notation (JSON) servers, or combinations thereof. Updated data may be pushed to the server (140) or may be pulled on-demand by the server (140). Notably, the FAA may be an important data server for both airspace data concerning flight paths and congestion as well as an important data server for regulatory data such as permanent and temporary airspace restrictions. For example, the FAA provides the Aeronautical Data Delivery Service (ADDS), the Aeronautical Product Release API (APRA), System Wide Information Management (SWIM), Special Use Airspace information, and Temporary Flight Restrictions (TFR) information, among other data. The National Weather Service (NWS) API allows access to forecasts, alerts, and observations, along with other weather data. The USGS Seamless Server provides geospatial data layers regarding places, structures, transportation, boundaries, hydrography, orthoimagery, land cover, and elevation. Readers of skill in the art will appreciate that various governmental and non-governmental entities may act as data servers and provide access to that data using APIs, JSON, XML, and other data formats.

Readers of skill in the art will realize that the server (140) can communicate with a UAV (102) using a variety of methods. For example, the UAV (102) may transmit and receive data using Cellular, 5G, Sub1 GHz, SigFox, WiFi networks, or any other communication means that would occur to one of skill in the art.

The network (119) may comprise one or more Local Area Networks (LANs), Wide Area Networks (WANs), cellular networks, satellite networks, internets, intranets, or other networks and combinations thereof. The network (119) may comprise one or more wired connections, wireless connections, or combinations thereof.

The arrangement of servers and other devices making up the exemplary system illustrated in FIG. 1 are for explanation, not for limitation. Data processing systems useful according to various embodiments of the present invention may include additional servers, routers, other devices, and peer-to-peer architectures, not shown in FIG. 1, as will occur to those of skill in the art. Networks in such data processing systems may support many data communications protocols, including for example TCP (Transmission Control Protocol), IP (Internet Protocol), HTTP (HyperText Transfer Protocol), and others as will occur to those of skill in the art. Various embodiments of the present invention may be implemented on a variety of hardware platforms in addition to those illustrated in FIG. 1.

Figure 2:
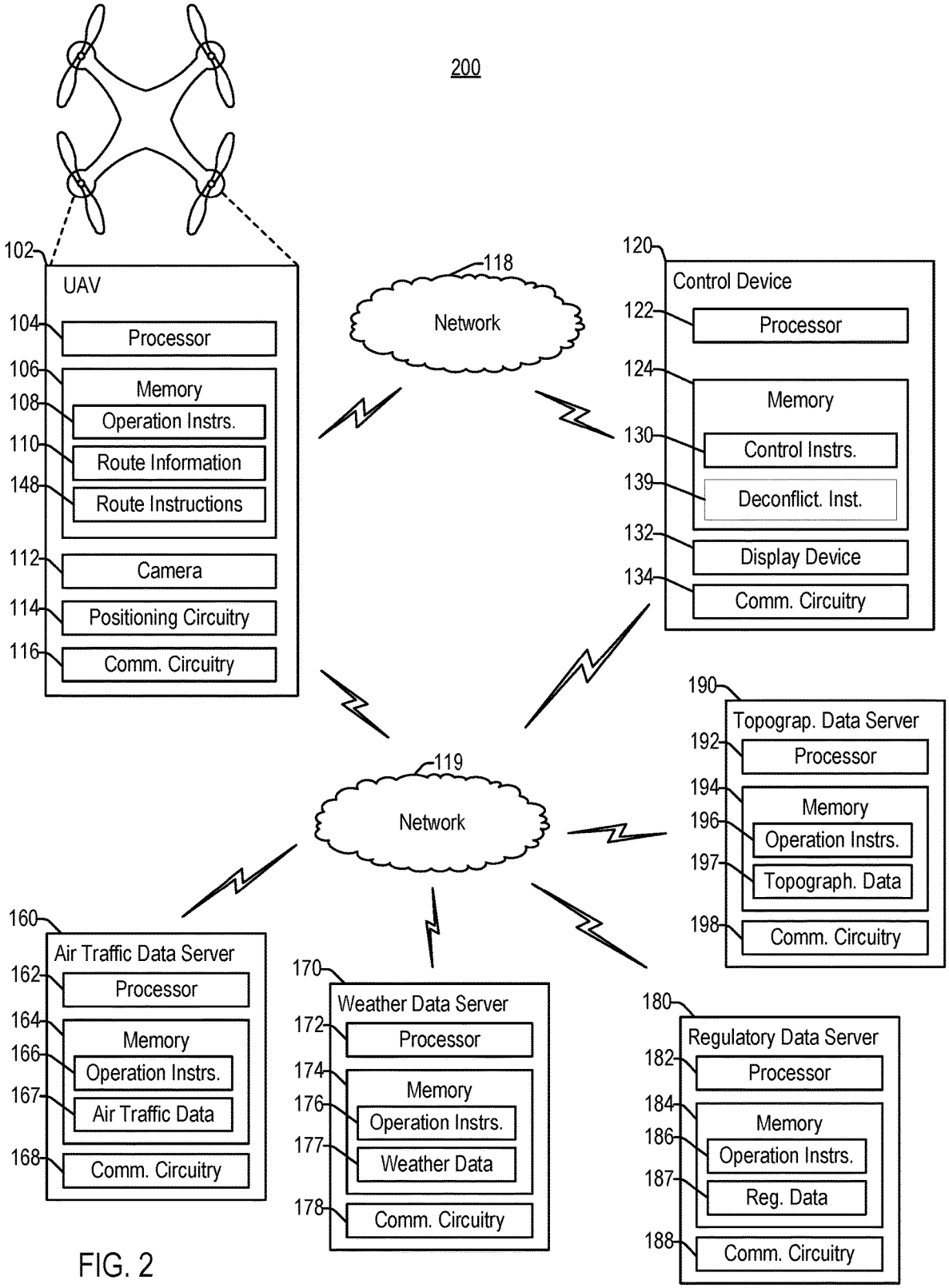
FIG. 2 is a block diagram illustrating another implementation of a system for flight path deconfliction among unmanned aerial vehicles.

For further explanation, FIG. 2 sets forth a block diagram illustrating another implementation of a system (200) for flight path deconfliction among unmanned aerial vehicles. Specifically, the system (200) of FIG. 2 shows an alternative configuration in which one or both of the UAV (102) and the server (140) may include route instructions (148) for generating route information. In this example, instead of relying on a server (140) to generate the route information, the UAV (102) and the control device (120) may retrieve and aggregate the information from the various data sources (e.g., the air traffic data server (160), the weather data server (170), the regulatory data server (180), and the topographical data server (190)). As explained in FIG. 1, the route instructions may be configured to use the aggregated information from the various source to plan and select a flight path for the UAV (102).

Figure 4:
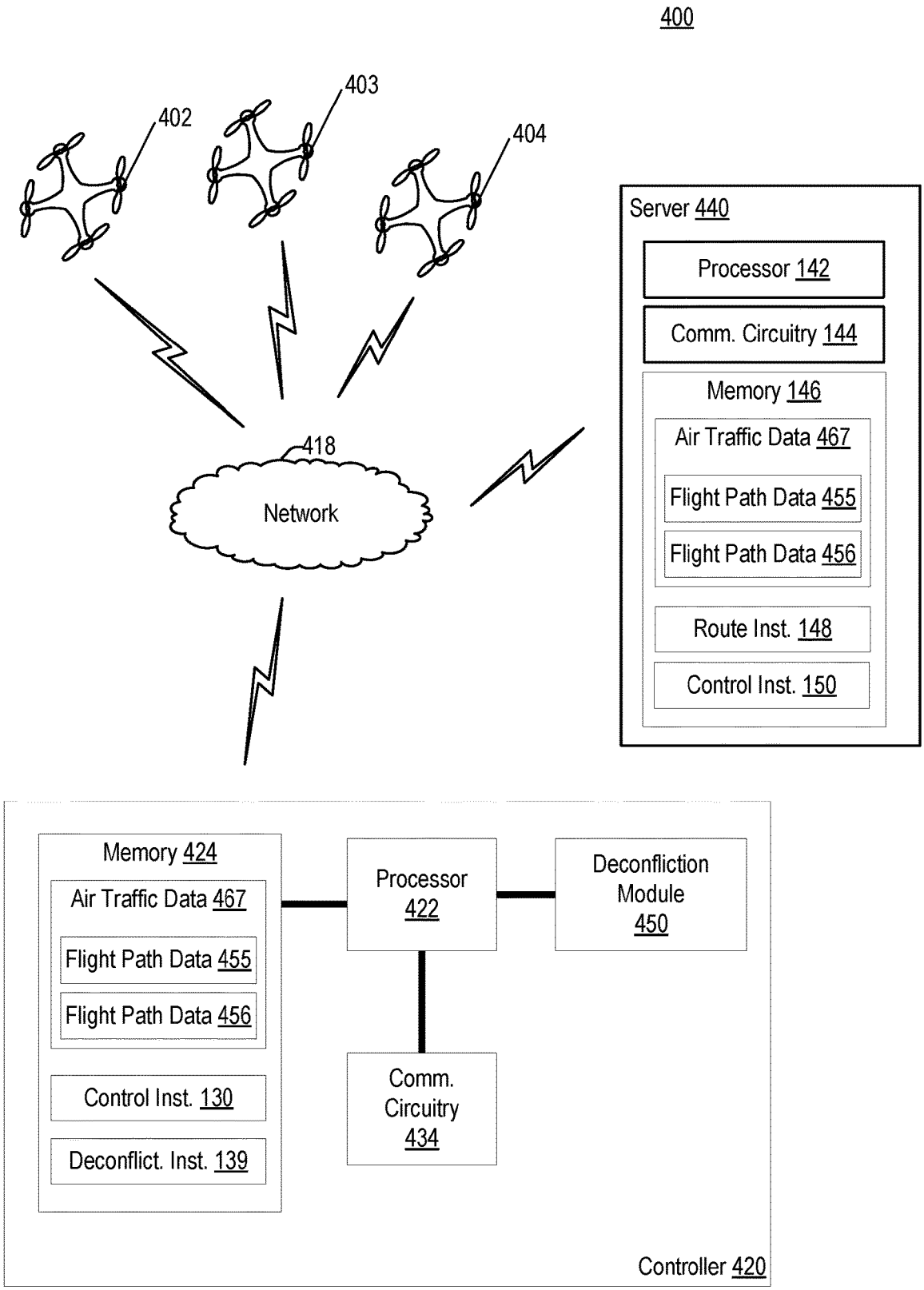
FIG. 4 is a block diagram illustrating a particular implementation of the system of FIGS. 1-2.

FIG. 4 is a block diagram illustrating a particular implementation of the system of FIGS. 1-2 showing a system (400) that includes a UAV network server (440) similarly configured as the server (140) of FIG. 1 or FIG. 2. The system (400) also includes a controller (420) similarly configured as the controller (120) of FIG. 1 or FIG. 2. The system (400) also includes one or more UAVs (402, 403, 404) similarly configured as the UAV (102) of FIG. 1 or FIG. 2. The system (400) also includes a network (418) similarly configured as the network (118) of FIG. 1 or FIG. 2. The UAVs (402, 403, 404) communicate with the UAV network server (440) and the controller (420) over the network (418), for example, to transmit telemetry data as described in more detail below. An operator of the UAVs (402, 403, 404) may register a stated flight plan with the UAV network server (440) or the controller (420). The UAV network server (440) is configured to provide flight path data representing stated flight plans.

In the example of FIG. 4, the UAV network server (440) may further provide the control device (420) with real-time air traffic data from the one or more air traffic data servers (160). The UAV network server (440) may also provide the control device (420) one or more models generated from aggregated data, such as air traffic data (167) from the air traffic data servers (160), weather data (177) from the weather data servers (170), regulatory data (187) from the regulatory data servers (180), and topographical data (197) from the topographic data servers (190), as described with reference to FIG. 1. In a particular embodiment, the UAV network server (440) is configured to communicate with a UAS data exchange, for example, the Low Altitude Authorization and Notification Capability (LAANC) system operated by the FAA.

In the example of FIG. 4, the controller (420) includes at least one deconfliction module (450) for deconfliction planning, including processing air traffic data (467) and rerouting a flight path to avoid collision with other aircraft. However, it will be appreciated by those of skill in the art the that the deconfliction module (450) may also be implemented in the UAV network server (440). Air traffic data (467) may be data such as real-time radar data indicating the presence of aircraft at or near a particular geographic location, flight path data indicating the anticipated course of an aircraft as it relates to a particular geographic location, reports of unidentified or "rogue" aircraft at a particular geographic location, and other data relating to airborne objects known or detected at a geographic location and altitude. Air traffic data may (467) be received by the UAV network server (440) from one or more air traffic data servers (160) such as, for example, the FAA, airport control towers, military bases, radar stations, and aircraft flight monitoring sources, UAV control systems, and others that will occur to those of skill in the art. Air traffic data (467) may also be data (e.g., location and other telemetry data) from other UAVs (403, 404) that are also in communication with the one or both of the controller (420) and the UAV network server (440). The air traffic data (467) may include flight path data (455, 456) (described in detail below) of the UAVs (402, 403, 404), which may be stored or buffered in a memory (424). A processor (422) is configured to receive air traffic data (467) via the communication circuitry (434) and provide input data generated from the air traffic data (467) to the deconfliction module (450).

In a particular embodiment, the controller (420) is configured to receive flight path data (455) for the UAV (402). The flight path (455) data may include route data indicating a stated flight plan (i.e., course of flight) as that stated course of flight traverses within the airspace corresponding to a boundary of a geographic cell (480) (see FIG. 5A). The route data may include, for example, an origination point, a destination point, waypoints, a plot of the path of flight, an entry point to the geographic cell, and an exit point from the geographic cell, all of which may be expressed in geospatial coordinates, GIS data, and other forms of location identification as will be recognized by those of skill in the art. The route data may further include altitudes for each point. The flight path data (455) may also include telemetry data received from the UAV (402) or from the UAV network server (440) over the network (418). The telemetry data may include GPS location coordinates of the UAV (402), current speed, altitude, pitch, yaw, and roll. In some embodiments, the telemetry data may further include sensor data from visual sensors (such as an optical or infrared camera), acoustic sensors (such as an echolocation device) or laser sensors. The controller (420) provides the flight path data (455) to the deconfliction module (450) as input data.

In this particular embodiment, the controller (420) is also configured to receive flight path data (456) for one or more other UAVs (403, 404) directly from the other UAVs (403, 404) or from the UAV network server (440). The flight path data (456) may include flight path data and course data of other UAVs (402, 403) that are also traversing the geographic cell and that are in the network of UAVs (490) coordinated by the UAV network server (440). The flight path data (456) may include route data indicating a stated flight plan (i.e., course of flight) as that stated course of flight traverses within the airspace corresponding to a boundary of the geographic cell (480) (see FIG. 5A). The route data may include, for example, an origination point, a destination point, waypoints, a plot of the path of flight, an entry point to the geographic cell (480), or an exit point from the geographic cell, all of which may be expressed in geospatial coordinates, GIS data, and other forms of location identification as will be recognized by those of skill in the art. The route data further includes altitudes for each point. The flight path data (456) may also include telemetry data received from the UAVs (403, 404) or from the UAV network server (440) over the network (418). The telemetry data of the UAVs (403, 404) may include GPS location coordinates of the UAVs, current speed, altitude, pitch, yaw, and roll. In some embodiments, the telemetry data may further include sensor data from visual sensors (such as an optical or infrared camera), acoustic sensors (such as an echolocation device) or laser sensors. The controller (420) provides the flight path data (456) to the deconfliction module (450) as input data.

In one embodiment, air traffic data (467) is pushed to the controller (420) over the network (418) in real-time or near real-time (e.g., once per second), and the air traffic data is fed to the deconfliction module (450) for processing. In another embodiment, air traffic data is requested by the controller (420) over the network (418) at a brief interval (e.g., once per second), and the received air traffic data is fed to the deconfliction module (450) for processing.

In a particular embodiment, the deconfliction module (450) is at least partially implemented by hardware logic that computes complex flight path deconfliction scenarios faster than using computer-implemented instructions executing on a general-purpose processor. Such hardware logic may be realized, in a particular embodiment, by an application-specific integrated circuit (ASIC). Typically, an ASIC includes circuitry comprising logic cells (e.g., AND gates, OR gates, multiplexers, flip-flops, etc.) and interconnects, which in turn form logic blocks for carrying out a specific function. A full-custom ASIC includes fixed interconnections among logic cells and logic blocks in customized mask layers and may further comprise analog circuitry. A semi-custom ASIC, such as a standard cell-based ASIC or a gate-array based ASIC, may use predefined libraries of logic cell masks or predefined transistor layouts with customizable interconnects. A programmable ASIC, such as a programmable logic device (PLD) or a field programmable gate array (FPGA), combined a matrix of programmable array logic cells and programmable interconnects embodied in a programmable read only memory (PROM), and may further include configurable I/O blocks, an arithmetic logic unit, and clock circuitry for both combinatorial and sequential logic functions. Configuration instructions for programmable logic may be implemented in a hardware description language (HDL) such as Verilog or the Very high-speed integrated circuits Hardware Description Language (VHDL). Hardware logic that at least partially implements the deconfliction module (450) may be realized by any of the aforementioned types of integrated circuits.

Although the deconfliction module (450) may be at least partially implemented by hardware logic, in some embodiments the deconfliction module (450) may be fully implemented by computer-readable instructions stored on a computer readable medium that, when executed by a processor, perform the features described herein.

The deconfliction module (450) is configured to receive, as input, the air traffic data (467) provided by the UAV network server (440). The air traffic data (467) may include flight path data and course data of UAVs (402, 403, 404) in a network of UAVs coordinated by the UAV network server (440). For example, flight path data of other UAVs may include a flight path of a UAV (402, 403, 404) in the UAV network, which may be dynamically updated as the flight path of that UAV is rerouted based on conditions encountered by that UAV (e.g., deconfliction, weather, airspace restrictions, etc). As another example, the flight path data UAVs (402, 403, 404) in the network of UAVs may include telemetry data transmitted by the UAVs (402, 403, 404) to the UAV network server (440), which may include instantaneous speed, pitch, yaw, and roll of a UAV in the UAV network. The air traffic data (467) may also include information about other aircraft observed by UAVs in the UAV network such as an observed UAV that is not participating in or reporting to the UAV network (e.g., a "rogue" UAV), or other aircraft not known to the UAV network server (440) from aggregated air traffic data (167).

The deconfliction module (450) is configured to receive, as input, real-time or near real-time telemetry data including location data transmitted by the UAVs (402, 403, 404). The location data may be, for example, geospatial coordinates from a GPS. For deconfliction planning, an airspace buffer zone is designated by the deconfliction module (450) around the geospatial location of the, for example, the UAV (402), as well as for each intended coordinate in the flight path. The airspace buffer zone is selected to account for error in GPS accuracy as well as for additional error in flight path navigation of the UAV (402) or flight path projection of a potential collision hazard. The deconfliction module (450) is configured to receive real-time telemetry data including course data transmitted by the UAV (402). The course data may include, for example, the instantaneous speed, yaw, pitch, and roll of the UAV (402), or data from sensors (e.g., infrared, LIDAR, SONAR, etc.) or from the camera (112).

The deconfliction module (450) is further configured to receive, as input, UAV attribute data. The UAV attribute data may be provided to the controller (420) by the UAV (402), the UAV network server (440), an external server (not shown), or other source of UAV specification data that will occur to those of skill in the art. The UAV attribute data may include the make and model of the UAV, UAV type, size (dimensions), maximum speed, weight, payload, maximum range, and the like.

The deconfliction module (450) is optimized to process the telemetry data of the UAV (402) and flight path data received from the UAV network server (440) or directly from the UAV (402) and to analyze the telemetry data and flight path data to identify potential conflicts in the flight path of the UAV (402) and the flight path of other UAVs (403, 404) and aircraft. That is, the deconfliction module (450) is configured to identify the risk of a potential collision of the UAV (402) with another airborne object based on intended or estimated flight paths of the UAV (402) and the other airborne object. The flight path data (455, 456) received from the UAV network server (440) may include an explicit intended flight path of the UAVs (402, 403, 404), in which case the deconfliction module (450) is configured to compare the current flight path of the UAV (402) and the intended flight path of the other UAV and determine, in view of the instant telemetry data received from the UAVs (402, 403, 404), whether the current flight path of, for example, the UAV (402) potentially intersects the flight path of the other UAVs (403, 404) at a particular time such that a collision might occur. The flight path data received from the UAV network server (440) may include an estimated flight path of UAVs (402, 403, 404) based on a course of that UAV, in which case the deconfliction module (450) is configured to compare the current flight path of, for example, the UAV (402) and the estimated flight path of the other UAVs (403, 404) and determine, in view of the instant telemetry data received from the UAV (402), whether the current flight path of the UAV (402) potentially intersects the flight path of the other UAV at a particular time such that a collision might occur. An intersection of flight paths may include whether the other UAV (403, 404) will enter the airspace buffer zone of the UAV (402). In addition to determining the existence of a potential for collision, the deconfliction module (450) may assign a risk value indicative of a likelihood of a collision based on a number of factors including, for example, whether the flight path of the other UAV is explicit or estimated, the telemetry data from the UAV (402), flight conditions including weather conditions, attributes of the UAV (402) (described in more detail below), and other factors that may affect the predictability of two airborne object colliding as will occur to readers of skill in the art. The deconfliction module (450) may also determine whether the risk value exceeds a threshold risk value, indicating that the risk of collision is too high and that rerouting or evasive maneuvers should be implemented. The determination may also include one or more of a risk value (e.g., a probability that the flight path conflict will result in collision), an approximate time window in which the flight conflict might occur, and an approximate coordinate and altitude of the potential collision.

The deconfliction module (450) is optimized to reroute a flight path of, for example, the UAV (402) to avoid the flight path conflict. That is, the deconfliction module (450) is configured to select a new flight path route that will cause the flight path of the UAV (402) to not intersect the flight path of the other UAV (403, 404) such that the two would collide, or will reduce the risk of collision below the threshold level. For example, the deconfliction module (450) may calculate a new waypoint (e.g., geospatial coordinates), the route to which will avoid collision or reduce the risk of collision with the other UAV. As another example, the deconfliction module (450) may calculate a new course for the UAV (402), including adjusting at least one of speed, altitude, yaw, pitch, and roll of the UAV (402) that will avoid collision or reduce the risk of collision with the other UAV (403, 404). As yet another example, the deconfliction module (450) may adjust the at least one of the speed or altitude of the UAV (402) to avoid collision or reduce the risk of collision with the other UAV (403, 404).

The deconfliction module (450) may be further configured to receive one or more models (441) provided by the UAV network server (440). For example, the one or more models (441) may include a cost model useful in determining a new flight path between a current location and a waypoint or destination. For example, the UAV network server (440) may aggregate data such as the air traffic data (167) from one or more air traffic data servers (160), the weather data (177) from one or more weather data servers (170), the regulatory data (187) from one or more regulatory data servers (180), and the topographic data (197) from one or more topographic data servers (190), generate a map of the aggregated data, partition the map into geographic cells, assign weights to the information in the aggregated data pertaining to a particular cell, compile the weighted information for each particular cell to generate a cost for that cell, and provide the navigational cost model to the deconfliction module (450). The controller (420) may request and/or receive the navigational cost model for the geographic area that pertains to the current location of the UAV (402) and/or the predicted point of collision. Based on the navigational cost model, the deconfliction module (450) is configured to determine a collision-avoidance flight path that adds the least amount of cost to the current flight path, and to reroute the flight path of the UAV (402) to avoid the flight path conflict.

The deconfliction module (450) is configured to output rerouted flight path data, which is transmitted to the UAV (402) by the controller (420) as navigation instructions. The rerouted flight path data may include the new waypoint or instructions to adjust the speed, altitude, yaw, pitch, and/or roll of the UAV (402). The rerouted flight path data is transmitted over the network (418) or via a direct communication channel between the controller (420) and the UAV (402).

Figure 5A:
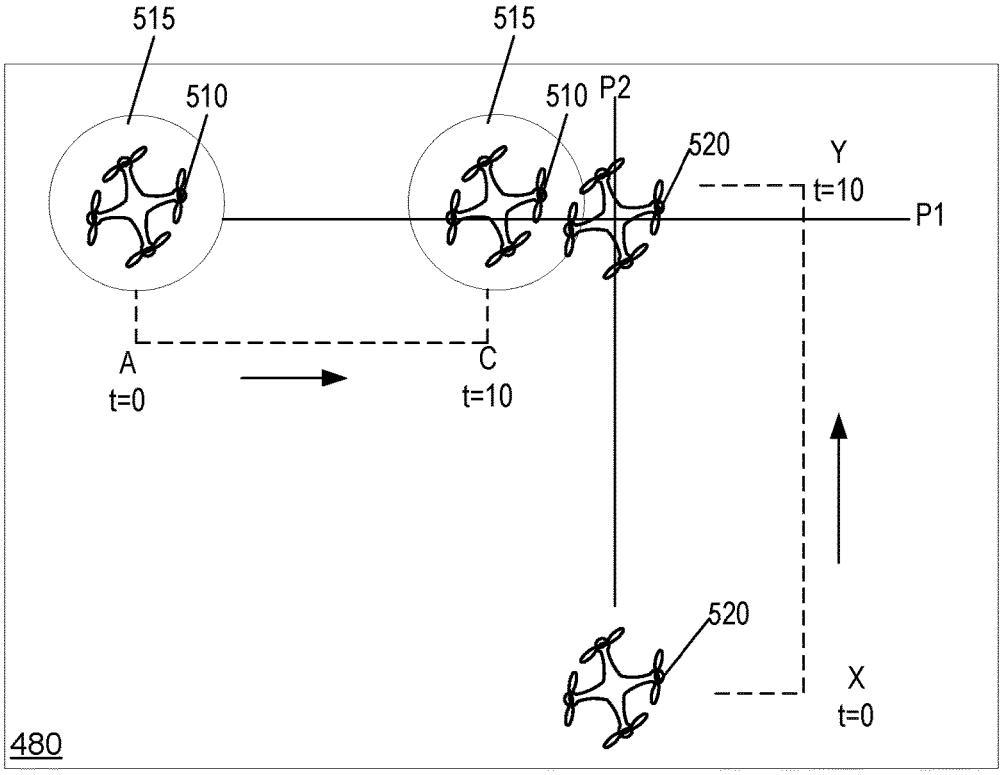
FIG. 5A is a diagram illustrating an example of a flight path conflict.

FIG. 5A illustrates an example of a potential collision between two UAVs in accordance with the present disclosure. In FIG. 5A, in the geographic cell (480), the first UAV (510) is at location A at time t=0 on flight path P1, while the second UAV (520) is at location X on a flight path P2 at time t=0. Flight paths P1 and P2 intersect. Based on predetermined flight paths, present course, or a combination thereof, the first UAV (510) is projected to be at location C at time t=10 and the second UAV (520) is projected to be at location Y at time t=10. It can be seen from FIG. 5A that, at time t=10, the second UAV (520) is projected to enter the buffer zone (515) of the first UAV (510). Accordingly, a high risk of collision between the first UAV (510) and the second UAV (520) exists.

Figure 5B:
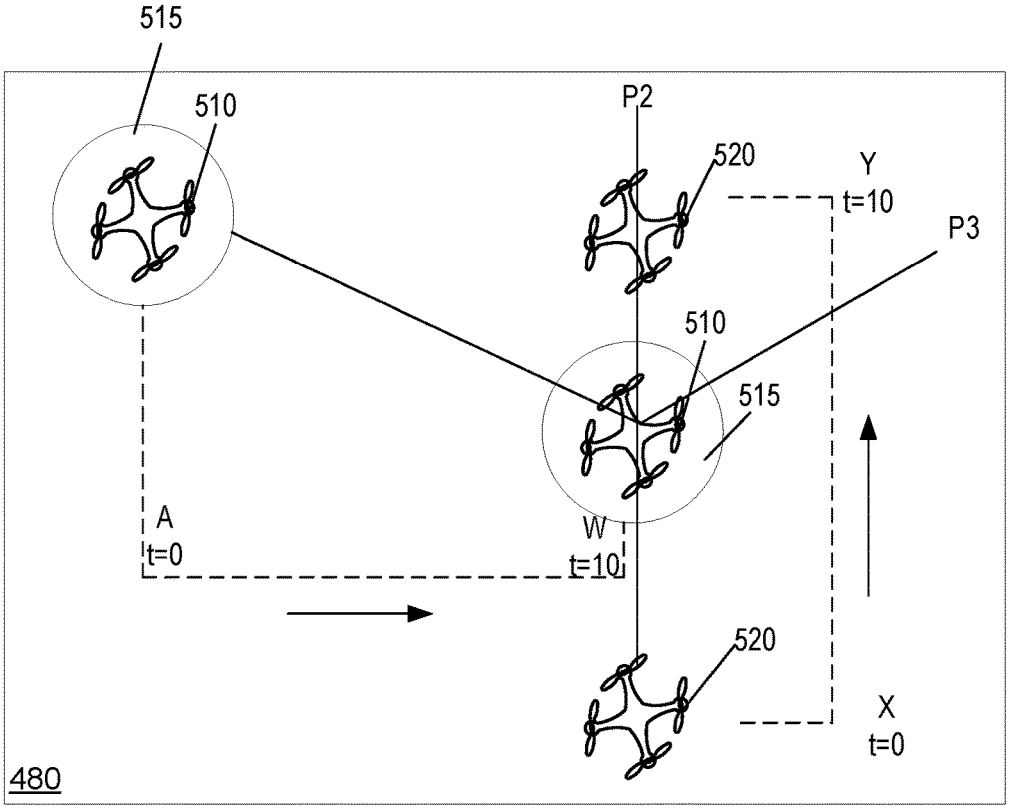
FIG. 5B is a diagram illustrating an example of flight path deconfliction.

FIG. 5B illustrates an example of flight path deconfliction to avoid the conflict depicted in FIG. 5A, in accordance with the present disclosure. In FIG. 5B, a new waypoint W is calculated for the first UAV (510) that will cause the first UAV (510) to intersect the flight path P2 at time t=10 after the second UAV (510) has already passed the waypoint W. Thus, at time t=10, the first UAV is at waypoint W and the second UAV (520) is at location Y. The new flight path P3 of the first UAV (510) adds a certain cost to the route of the first UAV (510) but reduces the risk of collision.

Figure 6:
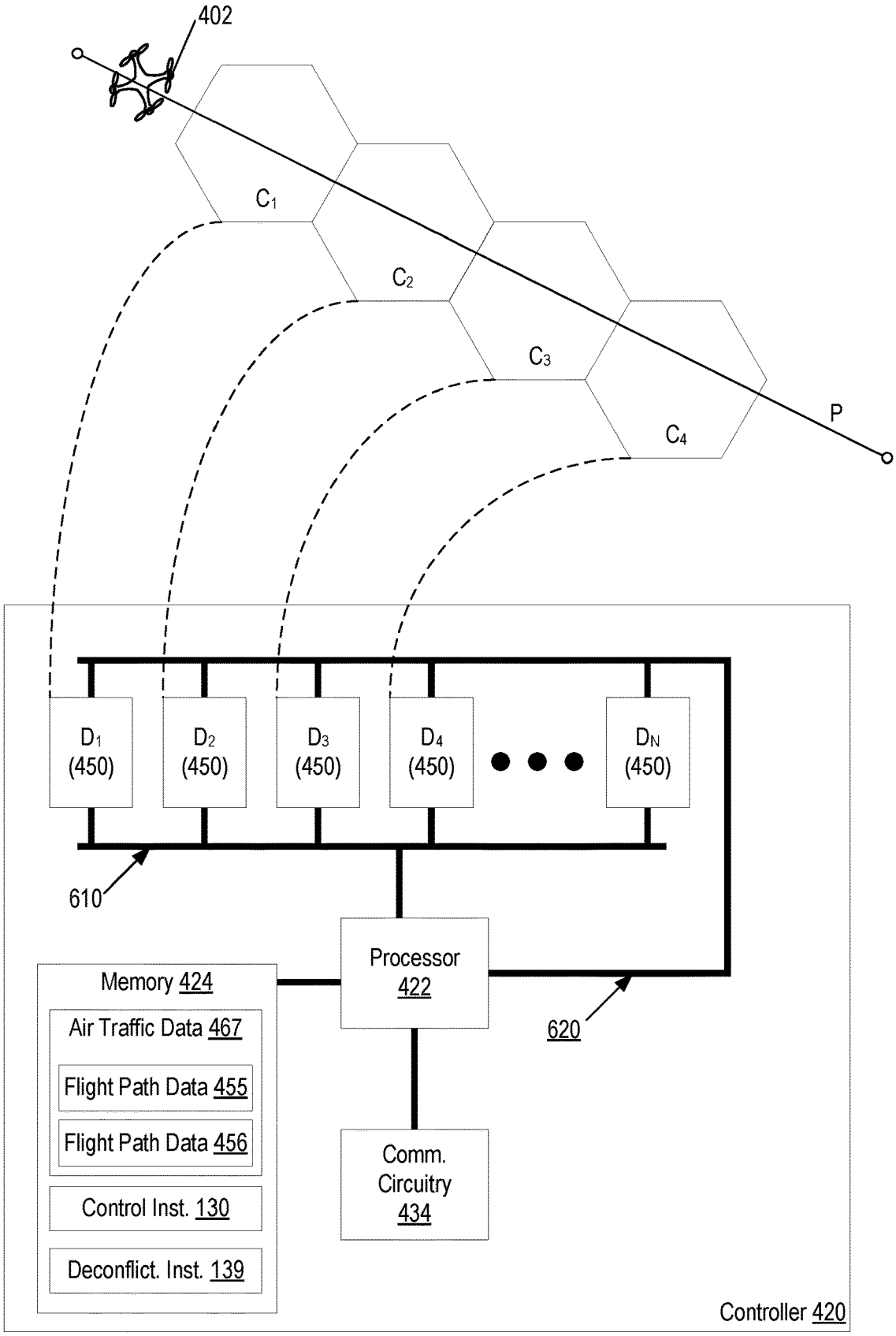
FIG. 6 is a block diagram illustrating a particular implementation of the system of FIG. 4.

FIG. 6 illustrates a particular implementation of the controller (420) in the system (400) of FIG. 4 in which the airspace over a geographic region has been partitioned, for example, by the UAV network server (440), into geographic cells $C_{1-N}$, with each geographic cell being respectively allocated to a deconfliction module $D_{1-N}$ such as deconfliction module (450). In this example, the controller (420) includes a plurality of deconfliction modules and each deconfliction module is assigned one or more geographic cells. In a particular embodiment, the controller (420) is a distributed computing system in which the plurality of deconfliction modules are distributed over a plurality of different devices in a plurality of different geographical areas. For example, a first deconfliction module of the plurality of deconfliction modules may be located on a first computing device in a first geographical location and a second deconfliction module of the plurality of deconfliction modules may be located on a second computing device in a second geographical location.

Map data for the geographic cells and corresponding airspace may be provided by the server (440) in an ArcGIS interface in GeoJSON format. In the example of FIG. 6, illustrating an example flight path P of the UAV (402), the geographic cell $C_1$ is administered by deconfliction module $D_1$, the geographic cell $C_2$ is administered by deconfliction module $D_2$, the geographic cell $C_3$ is administered by deconfliction module $D_3$, and the geographic cell $C_4$ is administered by deconfliction module $D_4$, as indicated by the broken lines. The processor (422) provides flight path data, for example flight path data (455, 456) to the deconfliction modules $D_{1-4}$ in parallel over an input bus (610). The deconfliction modules $D_{1-4}$ process the flight path data (455, 456) as it pertains to the geographic cells $C_{1-4}$ that they administer and output a determination that may include whether a flight conflict exists in their assigned geographic cell, as well as rerouting instructions for the flight path of the UAV (402). The output of deconfliction modules $D_{1-4}$ is received by the processor (422) over a results bus (620) for communicating clearance or rerouting instructions to the UAV (402). In some embodiments, a subset of deconfliction modules $D_{1-N}$ communicate with each other, for example, over a communication network (not shown) for providing deconfliction results directly to one another.

Figure 7:
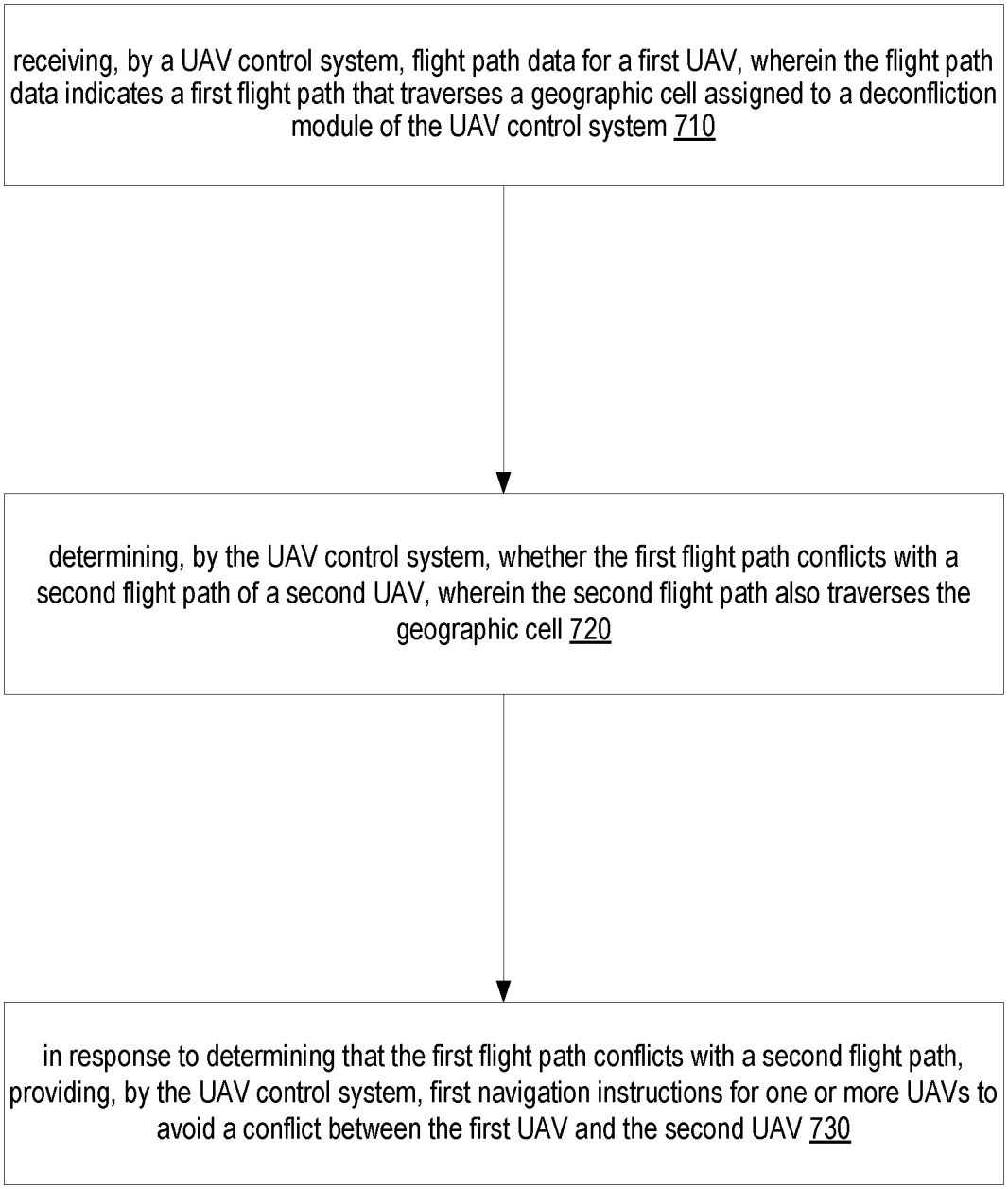
FIG. 7 is a flowchart to illustrate a particular implementation of a method for flight path deconfliction among unmanned aerial vehicles.

For further explanation, FIG. 7 sets forth a flow chart illustrating an exemplary method for flight path deconfliction among unmanned aerial vehicles according to embodiments of the present disclosure that includes a UAV control system receiving (710) flight path data for a first unmanned aerial vehicle (UAV), wherein the flight path data indicates a first flight path that traverses a geographic cell assigned to a deconfliction module of the UAV control system. An example of a UAV control system is the controller (420) of FIG. 4. Receiving (710) flight path data for a first unmanned aerial vehicle (UAV), wherein the flight path data indicates a first flight path that traverses a geographic cell assigned to the deconfliction module may be carried out by the UAV control system receiving flight path data (455) for the UAV (402) for the portion of the flight path that is within the boundary of the geographic cell (480). The flight path (455) data may include route data indicating a stated course of flight as that stated course of flight travels within the boundary of the geographic cell (480). The route data may include, for example, an origination point, a destination point, waypoints, a plot of the path of flight, an entry point to the geographic cell (480), and an exit point from the geographic cell (480), all of which may be expressed in geospatial coordinates, GIS data, and other forms of location identification as will be recognized by those of skill in the art. The route data further includes altitudes for each point. The flight path data (455) may also include telemetry data received from the UAV (402) or from the UAV network server (440) over the network (418). The telemetry data may include GPS location coordinates of the UAV (402), current speed, altitude, pitch, yaw, and roll. In some embodiments, the telemetry data may further include sensor data from visual sensors (such as an optical or infrared camera), acoustic sensors (such as an echolocation device) or laser sensors. The UAV control system provides the flight path data (455) to the deconfliction module (450) as input data.

In the example of FIG. 7, the UAV control system also receives flight path data (456) for one or more other UAVs (403, 404) directly from the other UAVs (403, 404) or from the UAV network server (440). The flight path data (456) may include flight path data and course data of other UAVs (402, 403) that are also traversing the geographic cell (480) and that are in the network of UAVs (490) coordinated by the UAV network server (440). The flight path data (456) may include route data indicating a stated course of flight as that stated course of flight travels within the boundary of the geographic cell (480). The route data may include, for example, an origination point, a destination point, waypoints, a plot of the path of flight, an entry point to the geographic cell (480), or an exit point from the geographic cell (480), all of which may be expressed in geospatial coordinates, GIS data, and other forms of location identification as will be recognized by those of skill in the art. The route data further includes altitudes for each point. The flight path data (456) may also include telemetry data received from the UAVs (403, 404) or from the UAV network server (440) over the network (418). The telemetry data of the UAVs (403, 404) may include GPS location coordinates of the UAVs, current speed, altitude, pitch, yaw, and roll. In some embodiments, the telemetry data may further include sensor data from visual sensors (such as an optical or infrared camera), acoustic sensors (such as an echolocation device) or laser sensors. The UAV control system provides the flight path data (456) to the deconfliction module (450) as input data.

The example method of FIG. 7 also includes the UAV control system determining (720) whether the first flight path conflicts with at least one second flight path of at least one second UAV, wherein the at least one second flight path also traverses the geographic cell. Determining (720) whether the first flight path conflicts with at least one second flight path of at least one second UAV, wherein the at least one second flight path also traverses the geographic cell, may be carried out by the deconfliction module (450) analyzing the flight path data (455) of the first UAV (402) and the flight path data (465) of one or more other UAVs (403, 404), comparing the projected location of each UAV (402, 403, 404) at points in time as the UAVs (402, 403, 404) travel within the boundary of the geographic cell, and determining whether the location the UAV (402) on its flight path at given time window is within a threshold distance of the location of another UAV (403, 404) on its flight path within the same given time window. That is, the deconfliction module (450) determines whether the intersection of two flight paths at a given time creates a risk of the UAV (402) colliding with another UAV (403, 404). An intersection of flight paths may include whether the other UAV (403, 404)) will enter the airspace buffer zone of the UAV (402).

The deconfliction module (450) may receive, as input data, the flight path data (455, 456) including telemetry data and route data received by the controller (420), and process the input data to identify the risk of a potential collision of the UAV (402) with the other UAVs (403, 404) based on stated or estimated flight paths of the UAV (402) and the other UAV (403, 404). The flight path data received by the controller (420) may include an explicitly stated flight path the other UAVs (403, 404), in which case the deconfliction module (450) is configured to compare the current flight path of the UAV (402) and the stated flight path of the other UAVs (403, 404) and determine whether the current flight path of the UAV (402) potentially intersects the flight path of the other UAVs (403, 404) at a particular time such that a collision might occur. The flight path data received by the controller (420) may include an estimated flight path of the other UAVs (403, 404) based on a course of each UAV, in which case the deconfliction module (450) is configured to compare the current flight path of the UAV (402) and the estimated flight path of the other UAV (403, 404) and determine whether the current flight path of the UAV (402) potentially intersects the flight path of the other UAV (402, 403) at a particular time such that a collision might occur.

In addition to determining the existence of a potential for collision, the deconfliction module (450) may assign a risk value indicative of a likelihood of a collision based on a number of factors including, for example, whether the flight path of the other UAV (403, 404) is explicit or estimated, the telemetry data from the UAV (402), flight conditions including weather conditions, attributes of the UAV (402), and other factors that may affect the predictability of two airborne object colliding as will occur to readers of skill in the art. The deconfliction module (450) may also determine whether the risk value exceeds a threshold risk value, indicating that the risk of collision is too high, as will be appreciated by those of skill in the art, and that rerouting or evasive maneuvers should be implemented.

Determining (720) whether the first flight path conflicts with a second flight path of a second UAV, wherein the second flight path also traverses the geographic cell, may result in a determination that the flight path of the first UAV (402) conflicts or potentially conflicts with the flight path of at least one of the other UAVs (403, 404), or may result in a determination that the flight path of the first UAV (402) does not conflict with the flight path of any of the other UAVs (403, 404). The determination may also include one or more of a risk value (e.g., a probability that the flight path conflict will result in collision), an approximate time window in which the flight conflict might occur, and an approximate coordinate and altitude of the potential collision.

The example method of FIG. 7 also includes the UAV control system in response to determining that the first flight path conflicts with a second flight path, providing (730), by the UAV control system, first navigation instructions for one or more UAVs to avoid a conflict between the first UAV and the second UAV. Providing (730), by the UAV control system, first navigation instructions for one or more UAVs to avoid a conflict between the first UAV and the second UAV may be carried out by the controller (420) transmitting navigation instructions to at least one of the UAVs (402, 403, 404) over the network (418). Each UAV (402, 403, 404) may receive different navigations instructions in dependence upon whether any of the UAVs (402, 403, 404) have conflicting flight paths. For example, the UAV control system may send navigation instructions to the UAV (402) for rerouting its flight path, whereas the controller (420) may send "all clear" instructions to UAVs (403, 404) to maintain their respective flight paths or no instructions at all. As another example, all of the UAVs (402, 403, 404) may receive individual navigation instructions for rerouting their respective flight paths.

Figure 8:
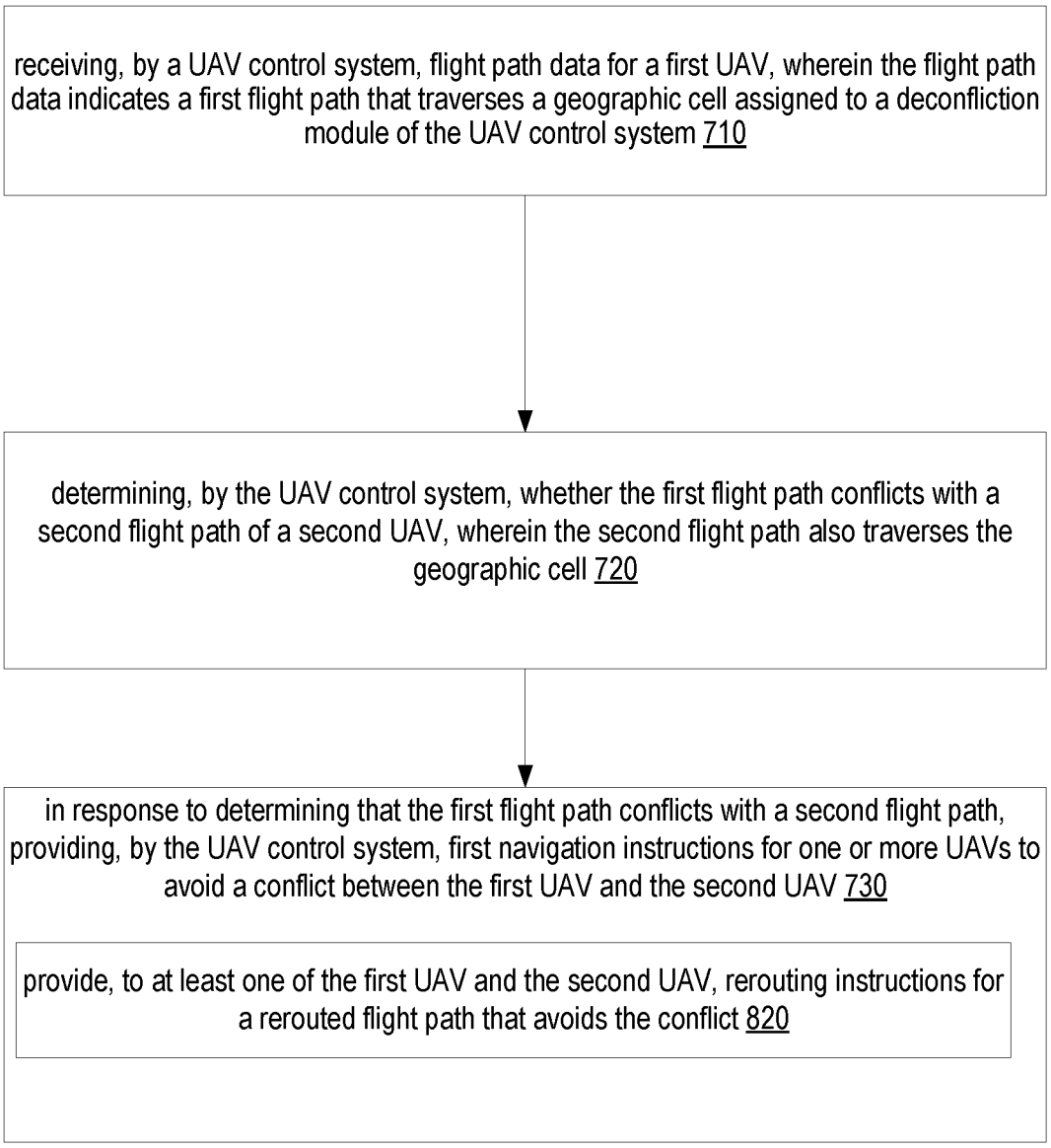
FIG. 8 is a flowchart to illustrate another implementation of a method for flight path deconfliction among unmanned aerial vehicles.

For further explanation, FIG. 8 sets forth a flow chart illustrating an exemplary method for flight path deconfliction among unmanned aerial vehicles according to embodiments of the present disclosure. Like the exemplary method of FIG. 7, the exemplary method of FIG. 8 also includes receiving (710) flight path data for a first unmanned aerial vehicle (UAV); determining (720) whether the first flight path conflicts with a second flight path of a second UAV, wherein the second flight path also traverses the geographic cell, and in response to determining that the first flight path conflicts with a second flight path, providing (730), by the UAV control system, first navigation instructions for one or more UAVs to avoid a conflict between the first UAV and the second UAV.

The exemplary method of FIG. 8 differs from the method of FIG. 7 in that providing (730), by the UAV control system, first navigation instructions for one or more UAVs to avoid a conflict between the first UAV and the second UAV includes providing (820), to at least one of the first UAV and the second UAV, rerouting instructions for a rerouted flight path that avoids the conflict.

In the method of FIG. 8, determining (810) that the first flight path conflicts with the second flight path may be carried out by the deconfliction module (450) analyzing the flight data (455, 456), compare the current flight path of the UAV (402) and the stated flight path of the other UAVs (403, 404), and determining that the current flight path of the UAV (402) potentially intersects the flight path of another UAVs (403, 404) at a particular time such that a collision might occur. For example, the deconfliction module (450) may determine that the UAV (402) and another UAV (403) may pass within a threshold distance of one another at a particular time or window of time based on the flight path data (455, 456). The deconfliction module may identify a coordinate where the projected flight paths of each UAV (402, 403) intersects, determine the proximity of each UAV (402, 403) to the intersection point for a series of time along the projected flight path, and determine whether there is a sufficient window of time or distance between the UAV (402) crossing the intersection point and the UAV (403) crossing the intersection point. The determination that a flight path conflict exists may be weighted by a risk value indicative of the probability of that a collision of UAVs will occur. For example, the risk value may be based on the amount of time or distance between the UAV (402) crossing the intersection point and the UAV (403) crossing the intersection point.

In the method of FIG. 8, providing (820), to at least one of the first UAV and the second UAV, rerouting instructions for a rerouted flight path that avoids the conflict may be carried out by the deconfliction module (450) rerouting a flight path of at least one of the UAVs (402, 403, 404) to avoid the flight path conflict. That is, the deconfliction module (450) is configured to select a new flight path route that will cause the flight path of, for example, the UAV (402) to not intersect the flight path of, for example, the UAV (403) at a time in which the two would collide or that reduces the risk of collision below the threshold level. For example, the deconfliction module (450) may calculate a new waypoint (e.g., geospatial coordinates) for the UAV (402), the route to which will avoid collision or reduce the risk of collision with another UAV (403). As another example, the deconfliction module (450) may calculate a new course for the UAV (402), including adjusting at least one of yaw, pitch, and roll of the UAV (402) that will avoid collision or reduce the risk of collision with the other UAV (403). As yet another example, the deconfliction module (450) may adjust the at least one of the speed or altitude of the UAV (402) to avoid collision or reduce the risk of collision with the other UAV (403). The deconfliction module (450) outputs rerouted flight path data to the controller (420).

Providing (820), to at least one of the first UAV and the second UAV, rerouting instructions for a rerouted flight path that avoids the conflict may be carried out by the controller (420) transmitting navigation instructions to, for example, the UAV (402) for executing a rerouted flight path. In one embodiment, the navigation instructions include instructions for the UAV (402) to travel to a new waypoint. In another embodiment, the navigation instructions include instructions for the UAV (402) to adjust the speed, altitude, yaw, pitch, and/or roll of the UAV (402). The navigation instructions are transmitted over the network (418) or via a direct communication channel between the controller (420) and the UAV (402). The controller (420) further transmits updated flight path information for the UAV (402) to the UAV network server (440).

Figure 9:
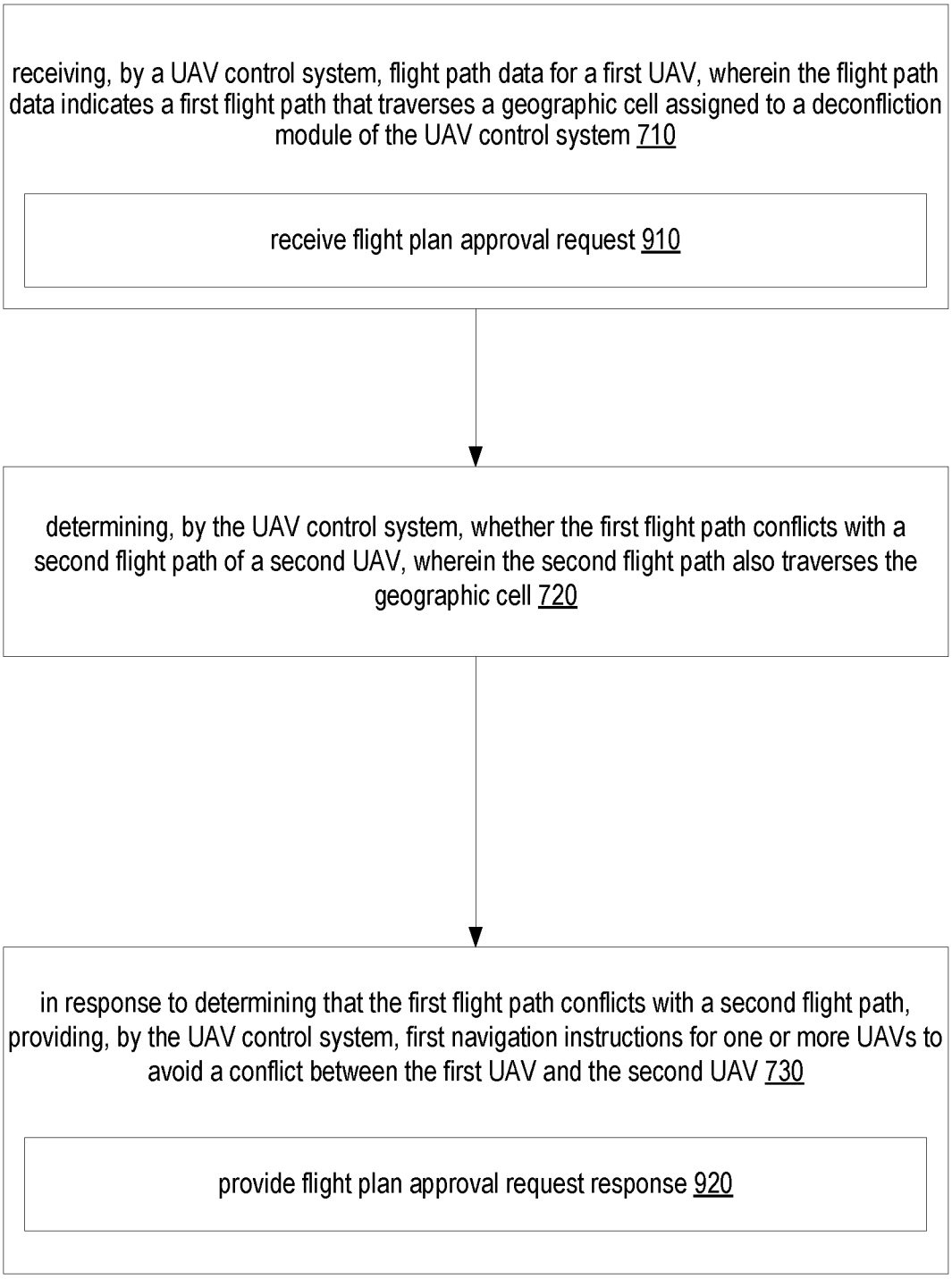
FIG. 9 is a flowchart to illustrate yet another implementation of a method for flight path deconfliction among unmanned aerial vehicles.

For further explanation, FIG. 9 sets forth a flow chart illustrating an exemplary method for flight path deconfliction among unmanned aerial vehicles according to embodiments of the present disclosure. Like the exemplary method of FIG. 7, the exemplary method of FIG. 9 also includes receiving (710) flight path data for a first unmanned aerial vehicle (UAV); determining (720) whether the first flight path conflicts with a second flight path of a second UAV, wherein the second flight path also traverses the geographic cell, and in response to determining that the first flight path conflicts with a second flight path, providing (730), by the UAV control system, first navigation instructions for one or more UAVs to avoid a conflict between the first UAV and the second UAV. The exemplary method of FIG. 9 differs from the method of FIG. 7 in that receiving (710) flight path data for a first unmanned aerial vehicle (UAV), wherein the flight path data indicates a first flight path that traverses a geographic cell assigned to the deconfliction module includes receiving (910) a flight path approval request, and in that the method further includes providing (920) a flight path approval response to the first UAV.

In the method of FIG. 9, receiving (910) a flight path approval request may be carried out by the controller (420) receiving, as part of or in addition to the flight path data (455), a request from the UAV (402) for permission to fly within the geographic cell (480) prior to entering the geographic cell (480). As the geographic cell (480) is assigned to the deconfliction module (450) for deconfliction processing, the controller (420) provides the flight path data (455) to the deconfliction module (450) for determining whether a conflict exists with another UAV (403, 404) that will be traveling in the geographic cell (480) concurrently with the UAV (402). Providing (920) a flight path approval response to the first UAV may be carried out by the controller (420) transmitting a message to the UAV (402) indicating that the flight path is approved, denied, or rerouted based on the determination by the deconfliction module (450) whether a conflict or potential conflict with the flight path of another UAV (403, 404) exists.

Figure 10:
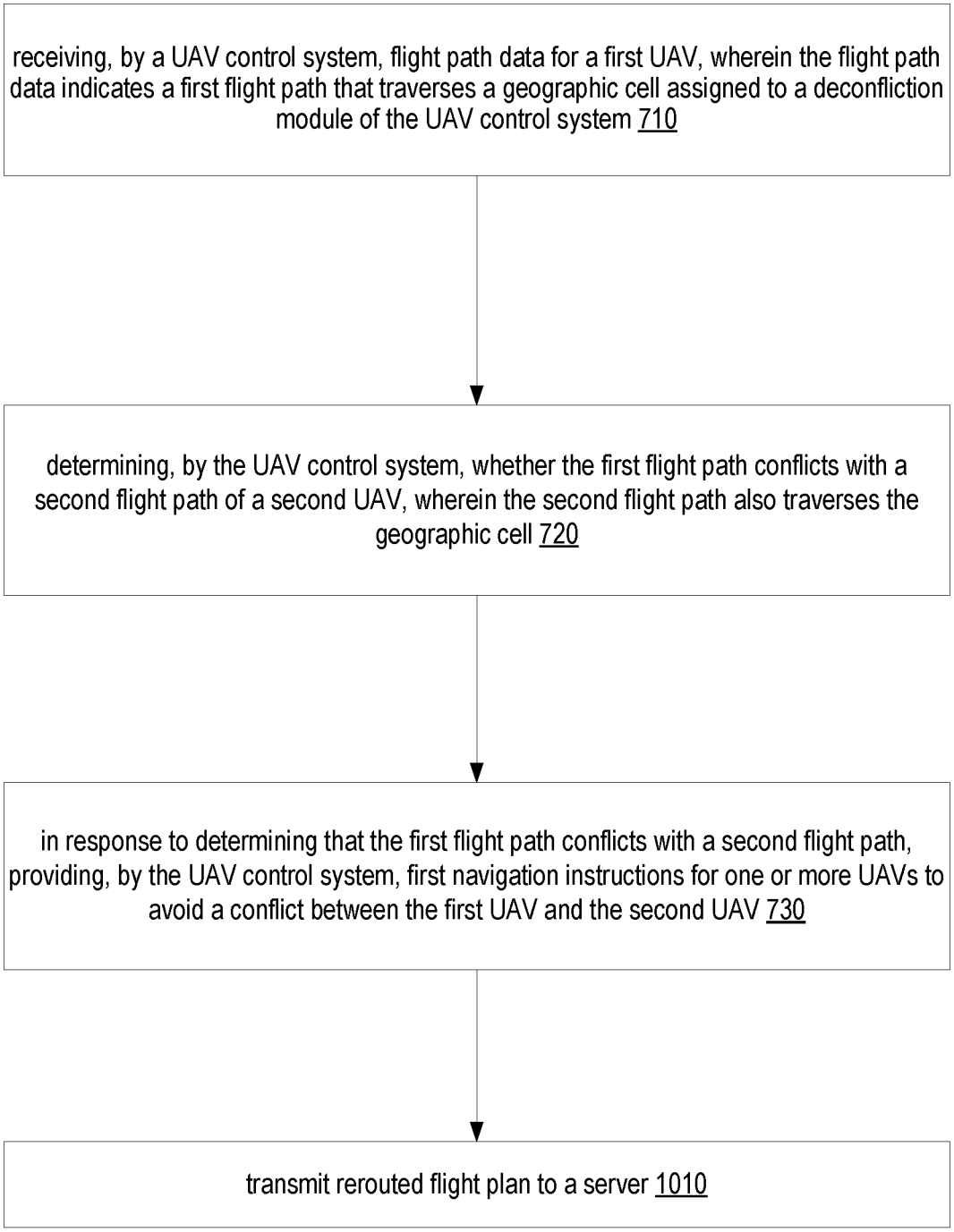
FIG. 10 is a flowchart to illustrate yet another implementation of a method for flight path deconfliction among unmanned aerial vehicles.

For further explanation, FIG. 10 sets forth a flow chart illustrating an exemplary method for flight path deconfliction among unmanned aerial vehicles according to embodiments of the present disclosure. Like the exemplary method of FIG. 7, the exemplary method of FIG. 10 also includes receiving (710) flight path data for a first unmanned aerial vehicle (UAV); determining (720) whether the first flight path conflicts with a second flight path of a second UAV, wherein the second flight path also traverses the geographic cell, and in response to determining that the first flight path conflicts with a second flight path, providing (730), by the UAV control system, first navigation instructions for one or more UAVs to avoid a conflict between the first UAV and the second UAV. The exemplary method of FIG. 10 differs from the method of FIG. 7 in that the method of FIG. 10 further comprises transmitting (1010) one or more rerouted flight paths to a server.

In the method of FIG. 10, transmitting (1010) one or more rerouted flight paths to a server may be carried out by the UAV control system transmitting flight path data for rerouted flight path data of one or more of the UAVs (402, 403, 404) to the server (440). In the system (400) coordinated by the server (440) and one or more controllers (420), flight path data for the UAVs (402, 403, 404) may be provided to the server (440) by the control device (420), and telemetry data and other in-flight data may be provided by the UAVs (402, 403, 404) to the server (440), such that server (440) is aware of the current location and intended flight paths of UAVs within the UAV network (418). In turn, the server (440) may provide one or more control devices (420) with information relevant to the navigability of a particular flight path, UAV location information to prevent the collision, in-flight information received from the UAVs (402, 403, 404) about weather conditions and obstructions, and the like. By transmitting (1010) rerouted flight paths to the server (440), the server (440) is apprised of changes to stated flight plans.

Figure 11:
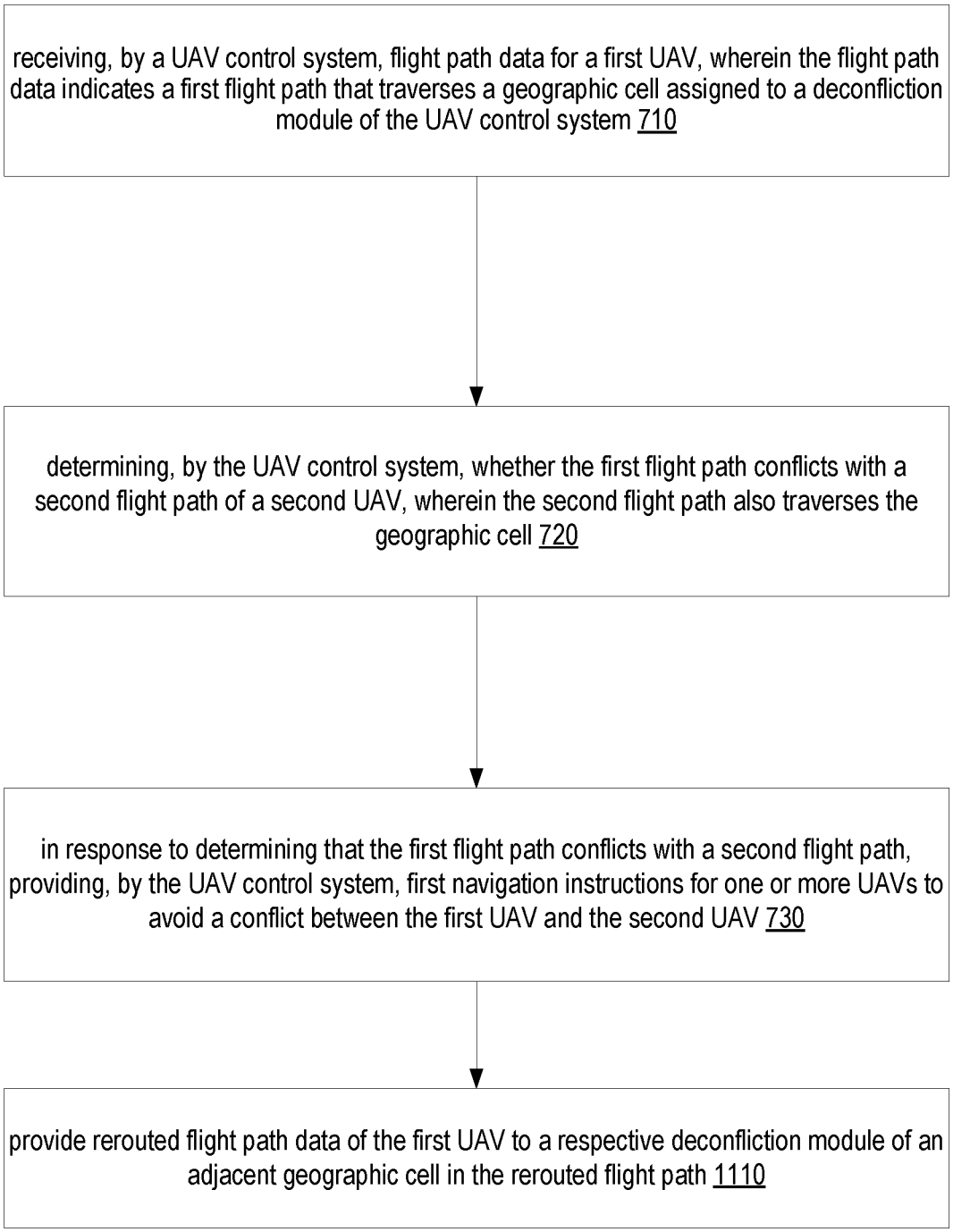
FIG. 11 is a flowchart to illustrate yet another implementation of a method for flight path deconfliction among unmanned aerial vehicles.

For further explanation, FIG. 11 sets forth a flow chart illustrating an exemplary method for flight path deconfliction among unmanned aerial vehicles according to embodiments of the present disclosure. Like the exemplary method of FIG. 7, the exemplary method of FIG. 11 also includes receiving (710) flight path data for a first unmanned aerial vehicle (UAV); determining (720) whether the first flight path conflicts with a second flight path of a second UAV, wherein the second flight path also traverses the geographic cell, and in response to determining that the first flight path conflicts with a second flight path, providing (730), by the UAV control system, first navigation instructions for one or more UAVs to avoid a conflict between the first UAV and the second UAV. The exemplary method of FIG. 11 differs from the method of FIG. 7 in that the method of FIG. 1 further comprises providing (1110) rerouted flight path data of the first UAV to a respective deconfliction module of an adjacent geographic cell in the rerouted flight path.

In the method of FIG. 11, providing (1110) rerouted flight path data of the first UAV to a respective deconfliction module of an adjacent geographic cell in the rerouted flight path may be carried out by the controller (420) determining that the flight path of the UAV will also cross into an adjacent geographic cell (680) allocated to another deconfliction module (650) operating in parallel with the deconfliction module (450) of the geographic cell (480). As previously described with respect to FIG. 6, the airspace over a geographic region is partitioned into geographic cells $C_{1\text{-}N}$, with each geographic cell being allocated a deconfliction module $D_{1\text{-}N}$ such as deconfliction module (450). Map data for the geographic cells and corresponding airspace may be provided by the server (440) in an ArcGIS interface in GeoJSON format. Based on the flight path data (455) received from the UAV (402), the controller (420) or server (440) may determine which geographic cells the flight path of the UAV (402) will traverse. Providing (1110) rerouted flight path data of the first UAV to a respective deconfliction module of an adjacent geographic cell in the rerouted flight path may be further carried out by the controller (420) causing rerouted flight path and the unique identifier of the UAV (402) to be passed from the deconfliction module $D_1$ (450) of the first geographic cell $C_1$ to the deconfliction module $D_2$ (450) of the adjacent geographic cell $C_2$. The controller (420) may provide the rerouted flight path and the unique identifier of the UAV (402) to the other deconfliction module $C_2$ (450) or the deconfliction module $D_1$ (450) may directly provide the adjacent deconfliction module $D_2$ (450) with the rerouted flight path and the unique identifier of the UAV (402). Thus, when the flight path of the UAV (402) traverses a set of geographic cells $C_{1\text{-}M}$ respectively controlled by deconfliction modules $D_{1\text{-}M}$, the deconfliction modules may operate in parallel to deconflict the flight path of the UAV (402) with the flight paths of other aircraft and provide rerouting instructions.

Figure 12:
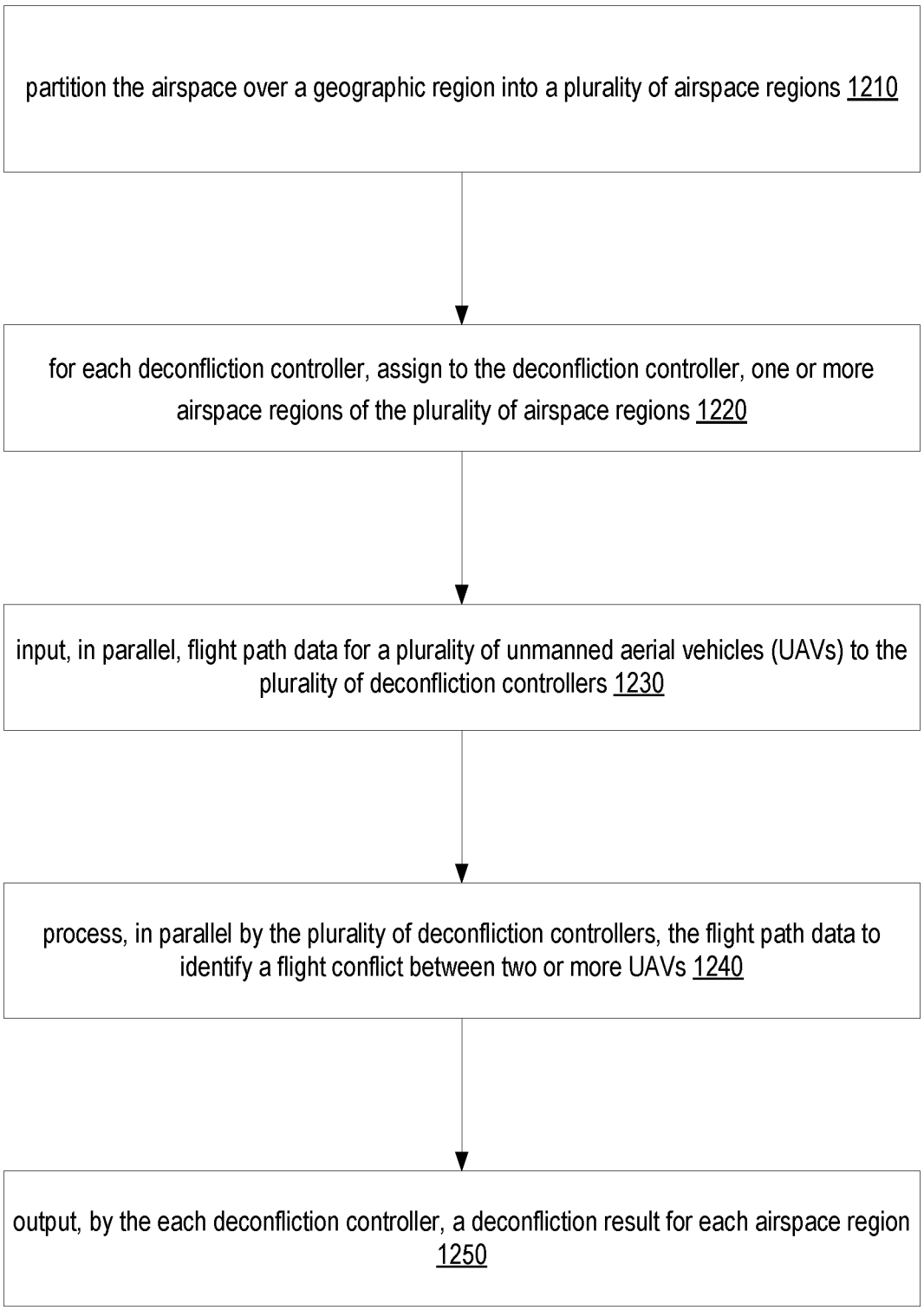
FIG. 12 is a flowchart to illustrate a particular implementation of a method for flight path deconfliction among unmanned aerial vehicles.

For further explanation, FIG. 12 sets forth a flow chart illustrating an exemplary method for flight path deconfliction among unmanned aerial vehicles according to embodiments of the present disclosure that includes partitioning (1210), by a UAV control system, the airspace over a geographic region into a plurality of airspace regions. In the example of FIG. 12, the UAV control system includes a plurality of deconfliction controllers. Partitioning (1210) the airspace over a geographic region into a plurality of airspace regions may be carried out by, for example, by the UAV network server (440) partitioning a map of a geographic region into geographic cells $C_{1\text{-}N}$, with each geographic cell have a corresponding airspace region (see FIG. 6). Map data for the geographic cells and corresponding airspace may be provided by the server (440) in an ArcGIS interface in GeoJSON format.

The method of FIG. 12 further includes for each deconfliction controller in the plurality of deconfliction controllers, assigning (1220) to the deconfliction controller, by the UAV control system, one or more airspace regions of the plurality of airspace regions. Assigning (1220) to the deconfliction controller, by the UAV control system, one or more airspace regions of the plurality of airspace regions may be carried out, for example, by the server (440) respectively allocating each geographic cell $C_{1\text{-}N}$, to a deconfliction module $D_{1\text{-}N}$, such as deconfliction module (450).

The method of FIG. 12 further includes inputting (1230), in parallel, flight path data for a plurality of unmanned aerial vehicles (UAVs) to the plurality of deconfliction controllers. Inputting (1230), in parallel, flight path data for a plurality of unmanned aerial vehicles (UAVs) to the plurality of deconfliction controllers may be carried out by a processor (424) inputting flight path data (455, 456) to the deconfliction modules $D_{1\text{-}M}$ in parallel over an input bus (610) (see FIG. 6).

The method of FIG. 12 further includes processing (1240), in parallel by the plurality of deconfliction controllers, the flight path data to identify a flight conflict between two or more UAVs. Processing (1240), in parallel by the respective deconfliction controllers, the flight path data to identify a flight conflict between two or more UAVs may be carried out by, for example, deconfliction modules $D_{1\text{-}M}$ processing the flight path data (455, 456) as it respectively pertains to the geographic cells $C_{1\text{-}M}$ that they administer.

The method of FIG. 12 further includes outputting (1250), by each deconfliction controller, a deconfliction result for each airspace region. Outputting (1250), by each deconfliction controller, a deconfliction result for each airspace region may be carried out by, for example, deconfliction modules $D_{1\text{-}M}$ outputting a determination that may include whether a flight conflict exists in their assigned geographic cell, as well as rerouting instructions for the flight path of the UAV (402). The output of deconfliction modules $D_{1\text{-}4}$ is received by the processor (422) over a results bus (620) for communicating clearance or rerouting instructions to the UAV (402).

Figure 13:
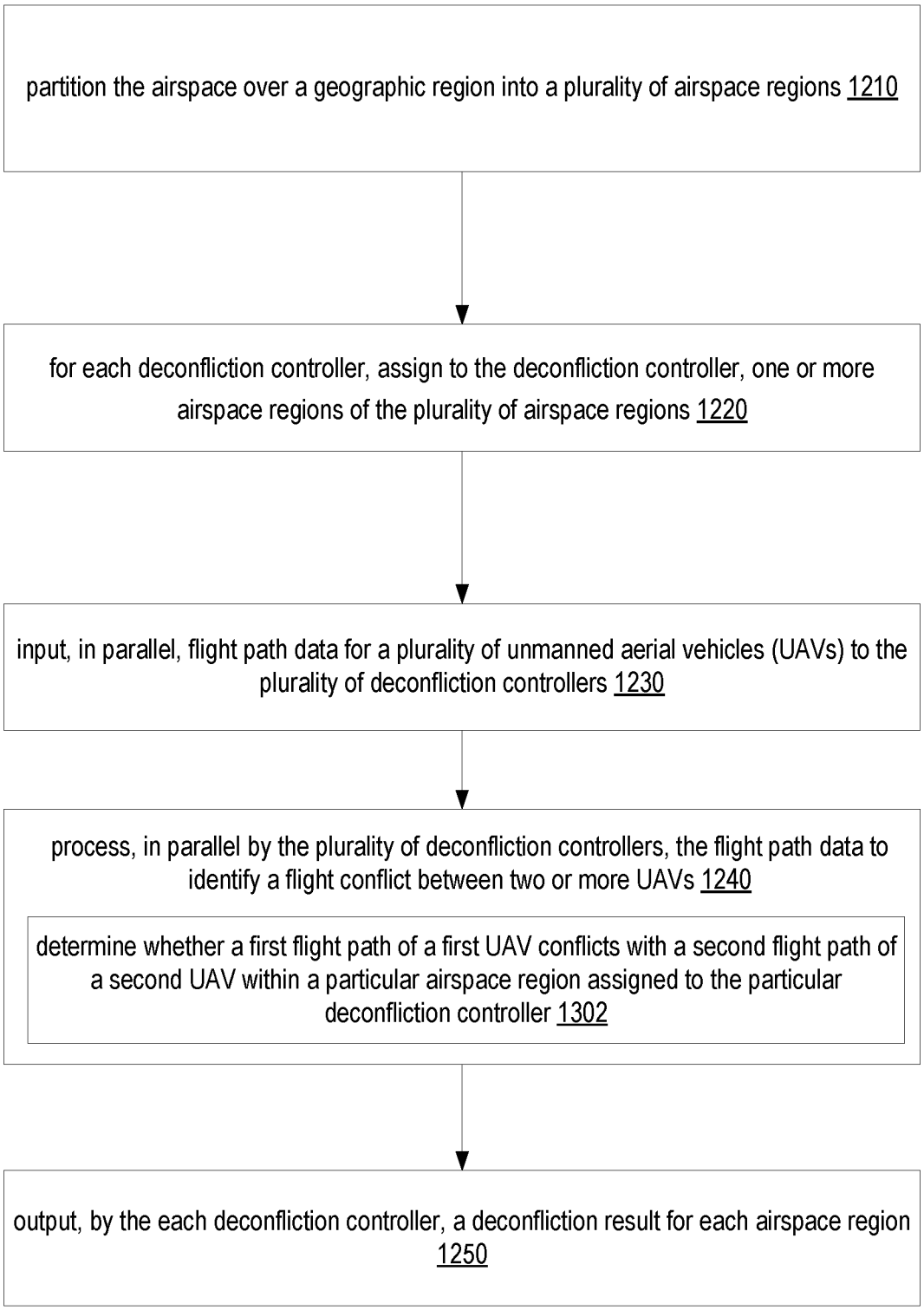
FIG. 13 is a flowchart to illustrate yet another implementation of a method for flight path deconfliction among unmanned aerial vehicles.

For further explanation, FIG. 13 sets forth a flow chart illustrating an exemplary method for flight path deconfliction among unmanned aerial vehicles according to embodiments of the present disclosure. Like the exemplary method of FIG. 12, the exemplary method of FIG. 13 also includes that includes partitioning (1210), by a UAV control system, the airspace over a geographic region into a plurality of airspace regions; for each deconfliction controller in the plurality of deconfliction controllers, assigning (1220) to the deconfliction controller, by the UAV control system, one or more airspace regions of the plurality of airspace regions; inputting (1230), in parallel, flight path data for a plurality of unmanned aerial vehicles (UAVs) to the plurality of deconfliction controllers; processing (1240), in parallel by the plurality of deconfliction controllers, the flight path data to identify a flight conflict between two or more UAVs; and outputting (1250), by each deconfliction controller, a deconfliction result for each airspace region.

In the method of FIG. 13, however, processing (1240), in parallel by the plurality of deconfliction controllers, the flight path data to identify a flight conflict between two or more UAVs includes determining (1302), by a particular deconfliction controller of the plurality of deconfliction controllers, whether a first flight path of a first UAV conflicts with a second flight path of a second UAV within a particular airspace region assigned to the particular deconfliction controller. Determining (1302), by a particular deconfliction controller of the plurality of deconfliction controllers, whether a first flight path of a first UAV conflicts with a second flight path of a second UAV within a particular airspace region assigned to the particular deconfliction controller may be carried out by the deconfliction module (450) of FIG. 6 analyzing the flight path data (455) of the first UAV (402) and the flight path data (465) of one or more other UAVs (403, 404), comparing the projected location of each UAV (402, 403, 404) at points in time as the UAVs (402, 403, 404) travel within the boundary of the geographic cell, and determining whether the location the UAV (402) on its flight path at given time window is within a threshold distance of the location of another UAV (403, 404) on its flight path within the same given time window. That is, the deconfliction module (450) determines whether the intersection of two flight paths at a given time creates a risk of the UAV (402) colliding with another UAV (403, 404). An intersection of flight paths may include whether the other UAV (403, 404)) will enter the airspace buffer zone of the UAV (402).

Figure 14:
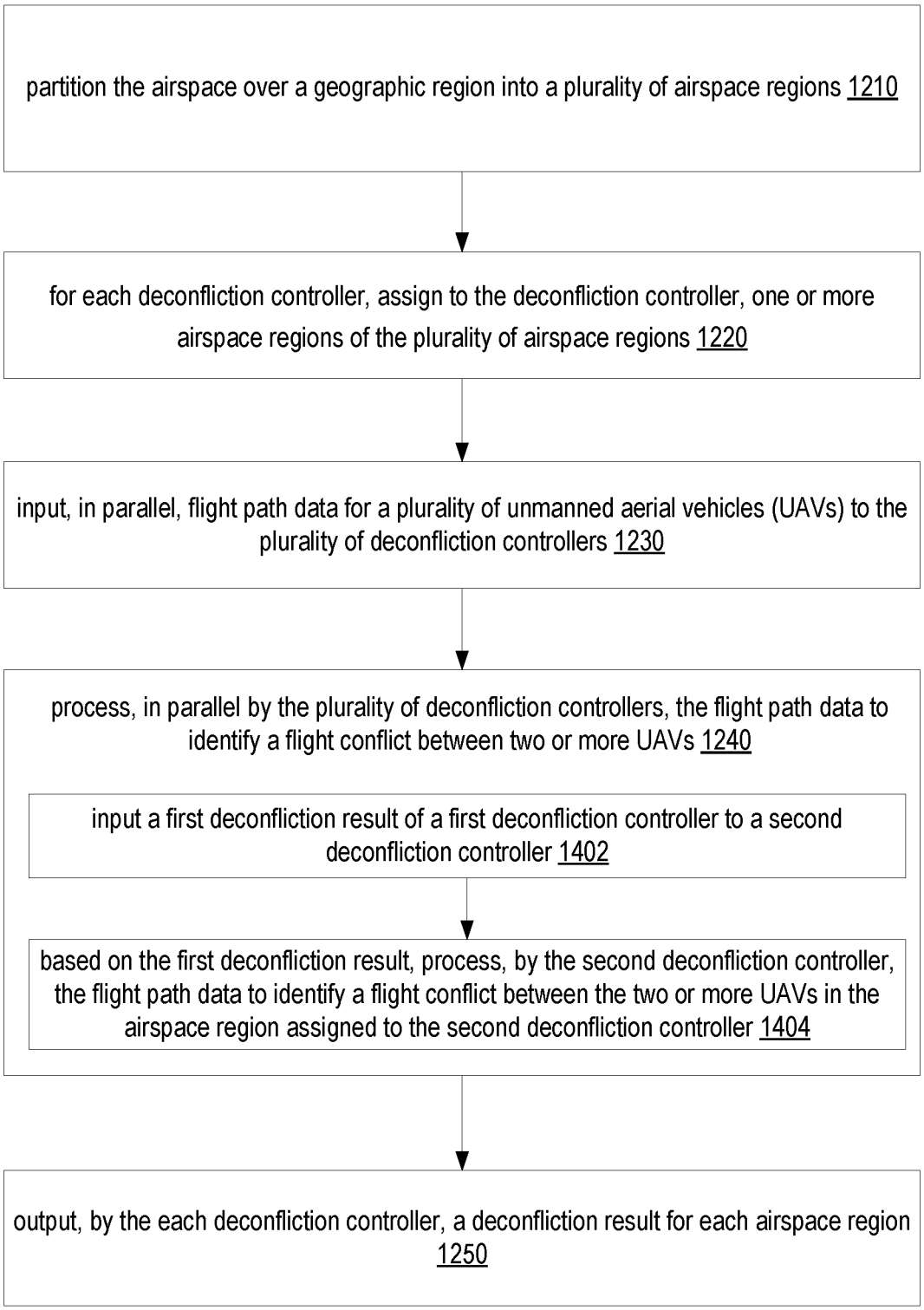
FIG. 14 is a flowchart to illustrate yet another implementation of a method for flight path deconfliction among unmanned aerial vehicles.

For further explanation, FIG. 14 sets forth a flow chart illustrating an exemplary method for flight path deconfliction among unmanned aerial vehicles according to embodiments of the present disclosure. Like the exemplary method of FIG. 12, the exemplary method of FIG. 14 also includes that includes partitioning (1210), by a UAV control system, the airspace over a geographic region into a plurality of airspace regions; for each deconfliction controller in the plurality of deconfliction controllers, assigning (1220) to the deconfliction controller, by the UAV control system, one or more airspace regions of the plurality of airspace regions; inputting (1230), in parallel, flight path data for a plurality of unmanned aerial vehicles (UAVs) to the plurality of deconfliction controllers; processing (1240), in parallel by the plurality of deconfliction controllers, the flight path data to identify a flight conflict between two or more UAVs; and outputting (1250), by each deconfliction controller, a deconfliction result for each airspace region.

In the method of FIG. 14, however, processing (1240), in parallel by the plurality of deconfliction controllers, the flight path data to identify a flight conflict between two or more UAVs includes inputting (1402) a first deconfliction result of a first deconfliction controller of the plurality of deconfliction controllers to a second deconfliction controller of the plurality of deconfliction controllers. Inputting (1402) a first deconfliction result of a first deconfliction controller of the plurality of deconfliction controllers to a second deconfliction controller of the plurality of deconfliction controllers may be carried out by transmitting the first deflection result to the second deconfliction controller.

In the method of FIG. 14, processing (1240), in parallel by the plurality of deconfliction controllers, the flight path data to identify a flight conflict between two or more UAVs also includes based on the first deconfliction result, processing (1404), by the second deconfliction controller, the flight path data to identify a flight conflict between the two or more UAVs in the airspace region assigned to the second deconfliction controller. Processing (1404), based on the first deconfliction result, the flight path data to identify a flight conflict between the two or more UAVs in the airspace region assigned to the second deconfliction controller may be carried out by the second deconfliction controller taking into consideration rerouting instructions in the first deconfliction result to assess whether the rerouted UAV has a flight path that creates a conflict in the airspace region assigned to the second deconfliction controller.

Figure 15:
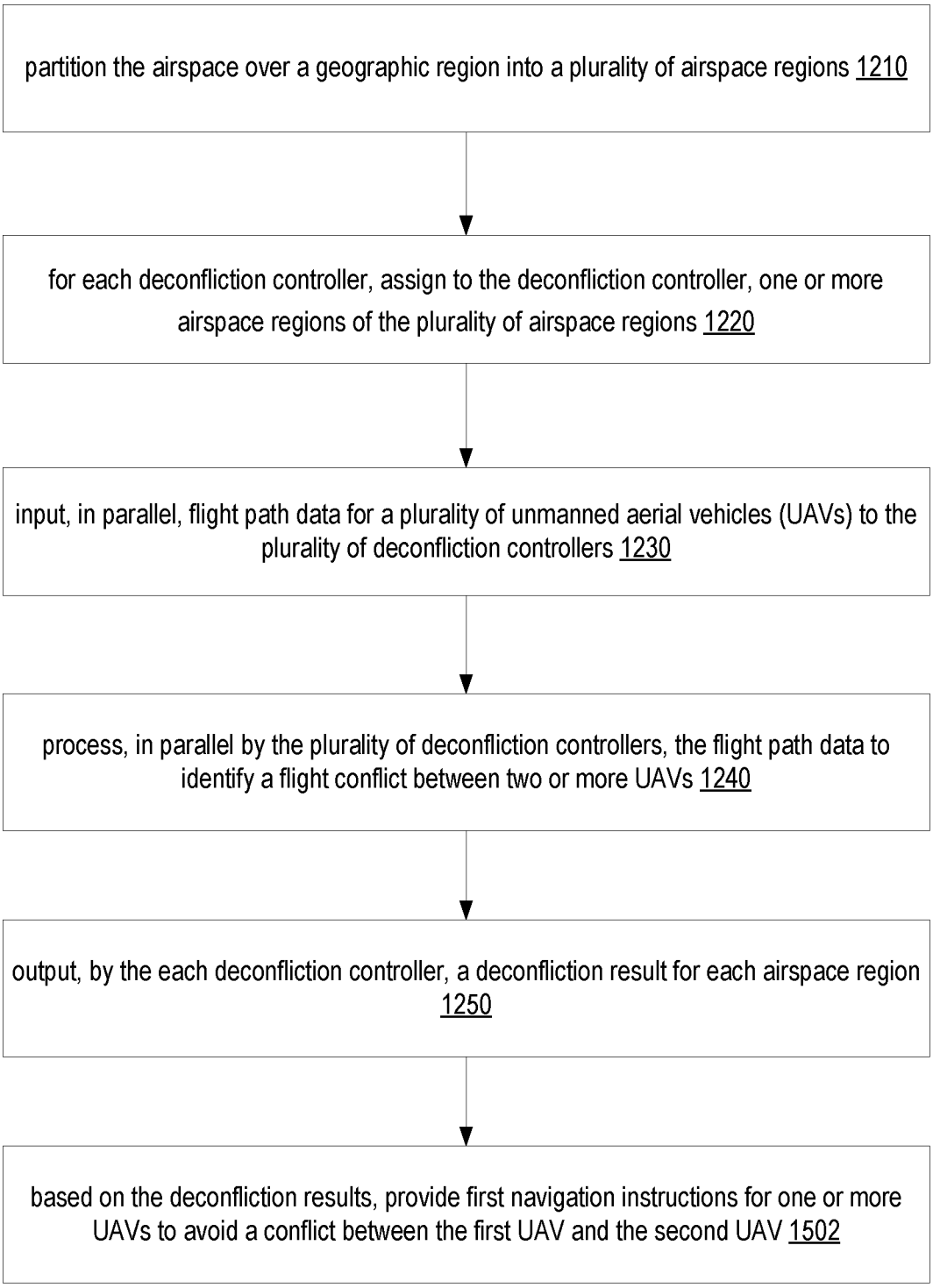
FIG. 15 is a flowchart to illustrate yet another implementation of a method for flight path deconfliction among unmanned aerial vehicles.

For further explanation, FIG. 15 sets forth a flow chart illustrating an exemplary method for flight path deconfliction among unmanned aerial vehicles according to embodiments of the present disclosure. Like the exemplary method of FIG. 12, the exemplary method of FIG. 15 also includes that includes partitioning (1210), by a UAV control system, the airspace over a geographic region into a plurality of airspace regions; for each deconfliction controller in the plurality of deconfliction controllers, assigning (1220) to the deconfliction controller, by the UAV control system, one or more airspace regions of the plurality of airspace regions; inputting (1230), in parallel, flight path data for a plurality of unmanned aerial vehicles (UAVs) to the plurality of deconfliction controllers; processing (1240), in parallel by the plurality of deconfliction controllers, the flight path data to identify a flight conflict between two or more UAVs; and outputting (1250), by each deconfliction controller, a deconfliction result for each airspace region.

The method of FIG. 15 also includes based on the deconfliction results, providing (1502), by the UAV control system, first navigation instructions for one or more UAVs to avoid a conflict between the first UAV and the second UAV. In a particular embodiment, the first navigation instructions may include control instructions. Providing (1502 based on the deconfliction results, first navigation instructions for one or more UAVs to avoid a conflict between the first UAV and the second UAV may be carried out by transmitting the first navigation instructions to one or both of the first UAV and the second UAV; transmitting the first navigation instructions to a control device or a server.

Figure 16:
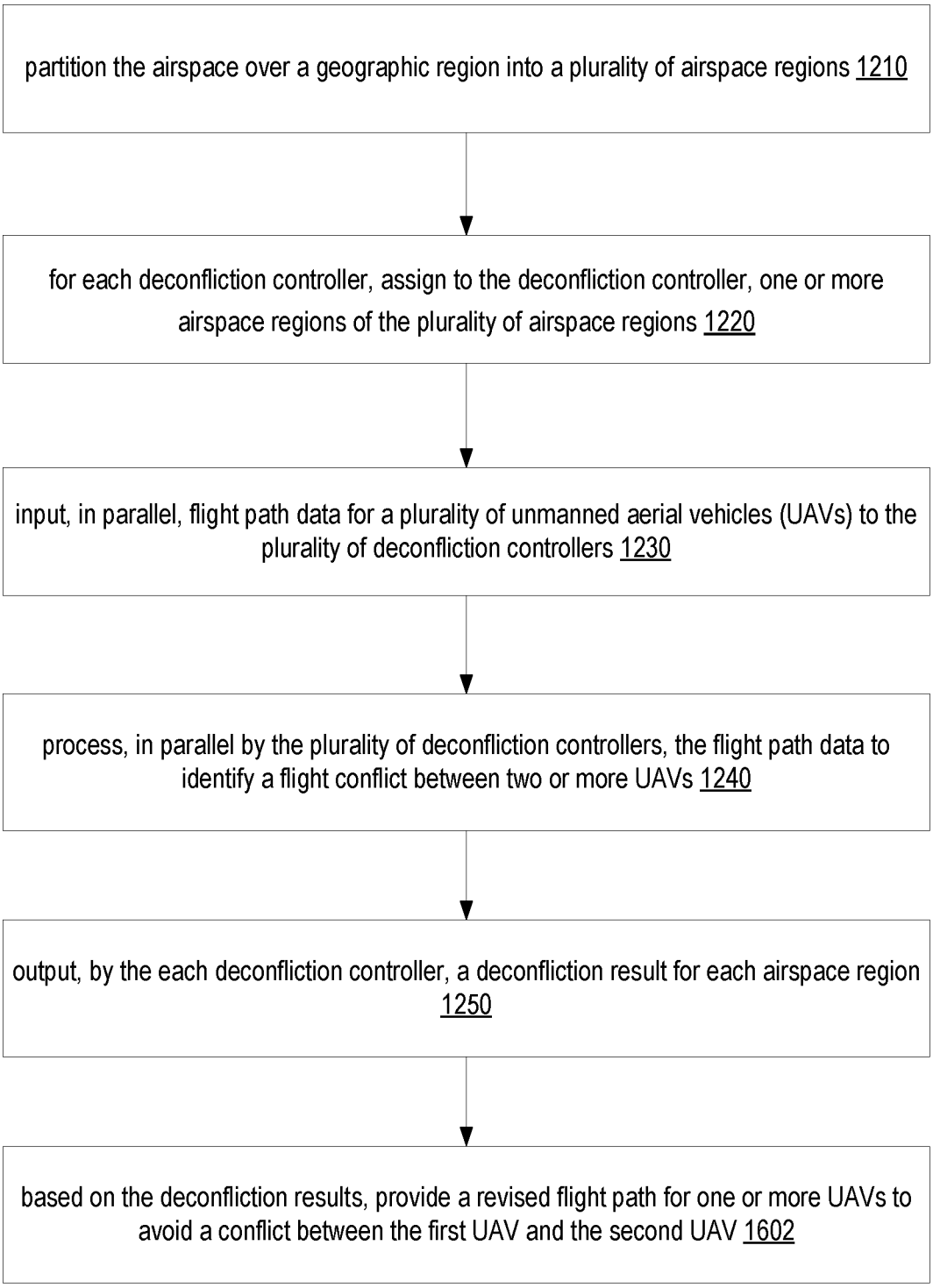
FIG. 16 is a flowchart to illustrate a particular implementation of a method for flight path deconfliction among unmanned aerial vehicles.

For further explanation, FIG. 16 sets forth a flow chart illustrating an exemplary method for flight path deconfliction among unmanned aerial vehicles according to embodiments of the present disclosure. Like the exemplary method of FIG. 12, the exemplary method of FIG. 16 also includes that includes partitioning (1210), by a UAV control system, the airspace over a geographic region into a plurality of airspace regions; for each deconfliction controller in the plurality of deconfliction controllers, assigning (1220) to the deconfliction controller, by the UAV control system, one or more airspace regions of the plurality of airspace regions; inputting (1230), in parallel, flight path data for a plurality of unmanned aerial vehicles (UAVs) to the plurality of deconfliction controllers; processing (1240), in parallel by the plurality of deconfliction controllers, the flight path data to identify a flight conflict between two or more UAVs; and outputting (1250), by each deconfliction controller, a deconfliction result for each airspace region.

The method of FIG. 16 also includes based on the deconfliction results, providing (1602), by the UAV control system, a revised flight path for one or more UAVs to avoid a conflict between the first UAV and the second UAV. Providing (1602), based on the deconfliction results, a revised flight path for one or more UAVs to avoid a conflict between the first UAV and the second UAV may be carried out by revised route information to a UAV, control device, or a server.

Figure 17:
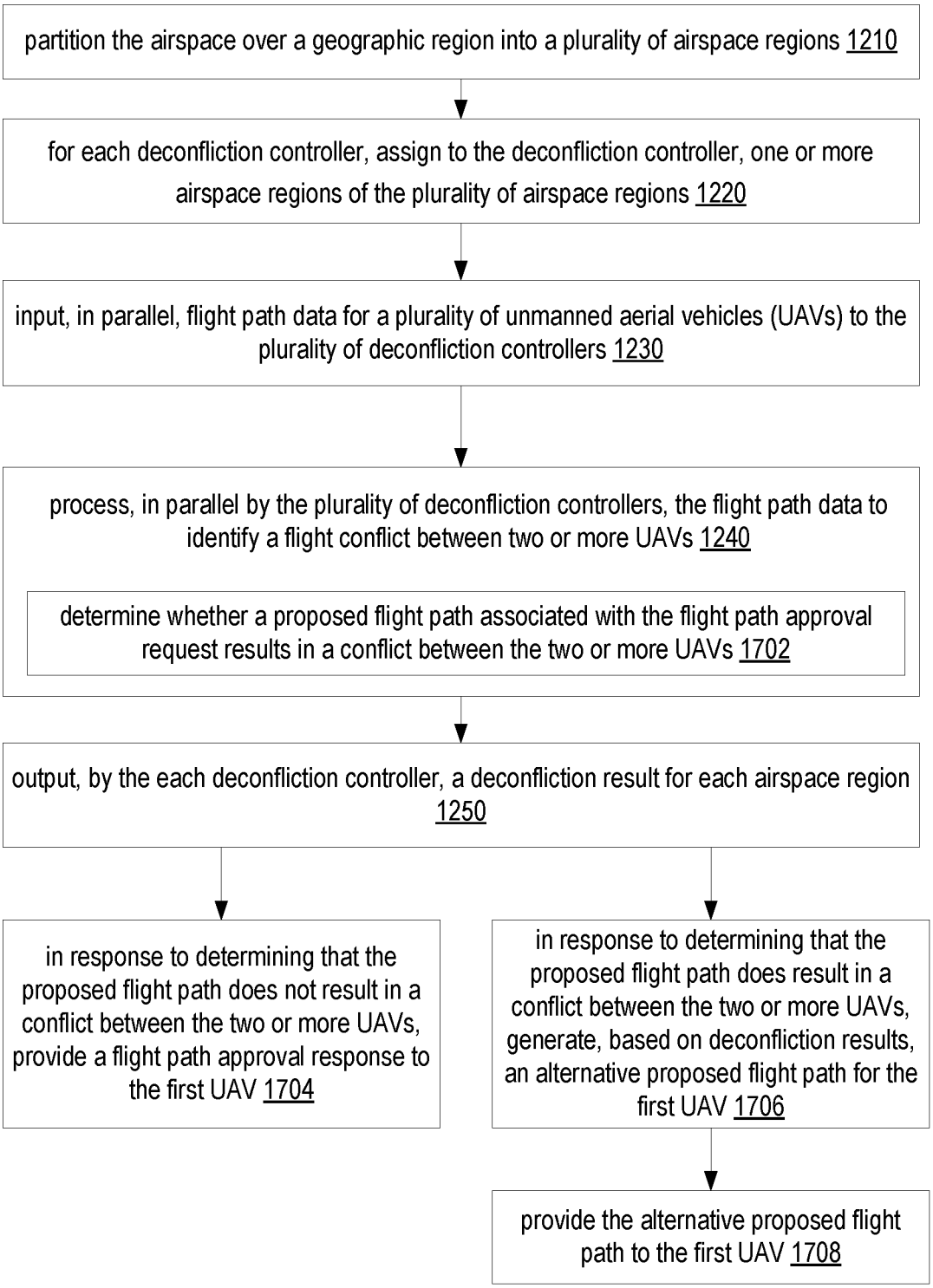
FIG. 17 is a flowchart to illustrate a particular implementation of a method for flight path deconfliction among unmanned aerial vehicles.

For further explanation, FIG. 17 sets forth a flow chart illustrating an exemplary method for flight path deconfliction among unmanned aerial vehicles according to embodiments of the present disclosure. Like the exemplary method of FIG. 12, the exemplary method of FIG. 17 also includes that includes partitioning (1210), by a UAV control system, the airspace over a geographic region into a plurality of airspace regions; for each deconfliction controller in the plurality of deconfliction controllers, assigning (1220) to the deconfliction controller, by the UAV control system, one or more airspace regions of the plurality of airspace regions; inputting (1230), in parallel, flight path data for a plurality of unmanned aerial vehicles (UAVs) to the plurality of deconfliction controllers; processing (1240), in parallel by the plurality of deconfliction controllers, the flight path data to identify a flight conflict between two or more UAVs; and outputting (1250), by each deconfliction controller, a deconfliction result for each airspace region.

In the method of FIG. 17, however, processing (1240), in parallel by the plurality of deconfliction controllers, the flight path data to identify a flight conflict between two or more UAVs includes determining (1702) whether a proposed flight path associated with the flight path approval request results in a conflict between the two or more UAVs. Determining (1702) whether a proposed flight path associated with the flight path approval request results in a conflict between the two or more UAVs may be carried out by deconfliction modules $D_{1\text{-}M}$ processing the flight path data (455, 456) as it respectively pertains to the geographic cells $C_{1\text{-}M}$ that they administer.

The method of FIG. 17 also includes in response to determining that the proposed flight path does not result in a conflict between the two or more UAVs, providing (1704) a flight path approval response to the first UAV. Providing (1704) a flight path approval response to the first UAV may be carried out by the UAV control system (e.g., the controller (402) of FIG. 4) transmitting a message to the UAV (402) indicating that the flight path is approved based on the determination by the deconfliction module (450) whether a conflict or potential conflict with the flight path of another UAV (403, 404) exists.

The method of FIG. 17 also includes in response to determining that the proposed flight path does result in a conflict between the two or more UAVS, generating (1706), based on the deconfliction results, an alternative proposed flight path for the first UAV. Generating (1706), based on the deconfliction results, an alternative proposed flight path for the first UAV may be carried out by the UAV control system (e.g., the controller (402) of FIG. 4) using models, topographical data, air traffic data, weather data, and regulatory data to generate a new flight path that does not present a conflict.

The method of FIG. 17 also includes providing (1708) the alternative proposed flight path to the first UAV. Providing (1708) the alternative proposed flight path to the first UAV may be carried out by the UAV control system (e.g., the controller (402) of FIG. 4) transmitting a message to the UAV (402) indicating that the flight path is not approved based on the determination by the deconfliction module (450) whether a conflict or potential conflict with the flight path of another UAV (403, 404) exists. In this example, the transmitted message may also include the alternative proposed flight path.

In view of the explanations set forth above, readers will recognize that the benefits of using parallel deconfliction modules to achieve high-speed processing of complex and voluminous flight path data that has been partitioned into airspace regions, which is advantageous to the fast response time required for collision avoidance among aircraft such as human-piloted or autonomous UAVs. With such safety precautions in place, the risk of in-air collisions among UAVs may be reduced.

Exemplary embodiments of the present invention are described largely in the context of a fully functional computer system for route planning for a UAV. Readers of skill in the art will recognize, however, that the present invention also may be embodied in a computer program product disposed upon computer readable storage media for use with any suitable data processing system. Such computer readable storage media may be any storage medium for machine-readable information, including magnetic media, optical media, or other suitable media. Examples of such media include magnetic disks in hard drives or diskettes, compact disks for optical drives, magnetic tape, and others as will occur to those of skill in the art. Persons skilled in the art will immediately recognize that any computer system having suitable programming means will be capable of executing the steps of the method of the invention as embodied in a computer program product. Persons skilled in the art will recognize also that, although some of the exemplary embodiments described in this specification are oriented to software installed and executing on computer hardware, nevertheless, alternative embodiments implemented as firmware or as hardware are well within the scope of the present invention.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Hardware logic, including programmable logic for use with a programmable logic device (PLD) implementing all or part of the functionality previously described herein, may be designed using traditional manual methods or may be designed, captured, simulated, or documented electronically using various tools, such as Computer Aided Design (CAD) programs, a hardware description language (e.g., VHDL or Verilog), or a PLD programming language. Hardware logic may also be generated by a non-transitory computer readable medium storing instructions that, when executed by a processor, manage parameters of a semiconductor component, a cell, a library of components, or a library of cells in electronic design automation (EDA) software to generate a manufacturable design for an integrated circuit. In implementation, the various components described herein might be implemented as discrete components or the functions and features described can be shared in part or in total among one or more components. Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method for parallel deconfliction processing of unmanned aerial vehicles (UAVs), the method comprising:

partitioning, by a UAV control system, the airspace over a geographic region into a plurality of airspace regions; the UAV control system including a plurality of deconfliction controllers;

for each deconfliction controller in the plurality of deconfliction controllers, assigning to the deconfliction controller, by the UAV control system, one or more airspace regions of the plurality of airspace regions;

inputting, in parallel by the UAV control system, first flight path data for a first UAV of a plurality of UAVs to the plurality of deconfliction controllers;

processing, in parallel by the plurality of deconfliction controllers, the first flight path data to identify a flight conflict between the first UAV and one or more other UAVs; and outputting, by each deconfliction controller, a deconfliction result for the first flight path data for each airspace region.

2. The method of claim 1 wherein processing, in parallel by the plurality of deconfliction controllers, the flight path data to identify a flight conflict includes:

determining, by a particular deconfliction controller of the plurality of deconfliction controllers, whether the first flight path of the first UAV conflicts with a second flight path of a second UAV within a particular airspace region assigned to the particular deconfliction controller.

3. The method of claim 1 further comprising:

based on the deconfliction results, providing, by the UAV control system, first navigation instructions for one or more UAVs to avoid a conflict between the first UAV and a second UAV.

4. The method of claim 1 further comprising:

based on the deconfliction results, providing, by the UAV control system, a revised flight path for one or more UAVs to avoid a conflict between the first UAV and a second UAV.

5. The method of claim 1, wherein the first flight path data includes a flight path approval request for the first UAV; and wherein processing, in parallel by the plurality of deconfliction controllers, the first flight path data to identify a flight conflict between the first UAV and one or more other UAVs includes determining whether a proposed flight path associated with the flight path approval request results in a conflict between the first UAV and the one or more other UAVs;

the method further comprising:

in response to determining that the proposed flight path does not result in a conflict, providing a flight path approval response to the first UAV.

6. The method of claim 5 further comprising:

in response to determining that the proposed flight path does result in a conflict, generating, based on the deconfliction results, an alternative proposed flight path for the first UAV; and providing the alternative proposed flight path to the first UAV.

7. The method of claim 1, wherein the UAV control system is a distributed computing system that includes a plurality of computing devices located in a plurality of geographical areas; wherein a first deconfliction controller of the plurality of deconfliction controllers is located on a first computing device in a first geographical location and a second deconfliction controller of the plurality of deconfliction controllers is located on a second computing device in a second geographical location.

8. The method of claim 1, wherein each deconfliction controller of the plurality of deconfliction controllers is an application-specific integrated circuit optimized for flight path deconfliction processing.

9. An apparatus for parallel deconfliction processing of unmanned aerial vehicles (UAVs), the apparatus comprising:

a processor; and a memory storing instructions, the instructions executable by the processor to:

partition, by a UAV control system, the airspace over a geographic region into a plurality of airspace regions; the UAV control system including a plurality of deconfliction controllers;

for each deconfliction controller in the plurality of deconfliction controllers, assign to the deconfliction controller, by the UAV control system, one or more airspace regions of the plurality of airspace regions;

input, in parallel by the UAV control system, first flight path data for a first UAV of a plurality of UAVs to the plurality of deconfliction controllers;

process, in parallel by the plurality of deconfliction controllers, the first flight path data to identify a flight conflict between the first UAV and one or more other UAVs; and output, by each deconfliction controller, a deconfliction result for the first flight path data for each airspace region.

10. The apparatus of claim 9 wherein processing, in parallel by the plurality of deconfliction controllers, the first flight path data to identify a flight conflict includes:

determining, by a particular deconfliction controller of the plurality of deconfliction controllers, whether the first flight path of the first UAV conflicts with a second flight path of a second UAV within a particular airspace region assigned to the particular deconfliction controller.

11. The apparatus of claim 9 further comprising instructions executable by the processor to:

based on the deconfliction results, providing, by the UAV control system, first navigation instructions for one or more UAVs to avoid a conflict between the first UAV and a second UAV.

12. The apparatus of claim 9 further comprising instructions executable by the processor to:

based on the deconfliction results, providing, by the UAV control system, a revised flight path for one or more UAVs to avoid a conflict between the first UAV and a second UAV.

13. The apparatus of claim 9, wherein the first flight path data includes a flight path approval request for the first UAV; and wherein processing, in parallel by the plurality of deconfliction controllers, the first flight path data to identify a flight conflict between the first UAV and one or more other UAVs includes determining whether a proposed flight path associated with the flight path approval request results in a conflict between the first UAV and the one or more other UAVs;

the apparatus further comprising instructions executable by the processor to:

in response to determining that the proposed flight path does not result in a conflict, providing a flight path approval response to the first UAV.

14. A non-transitory computer-readable medium for parallel deconfliction processing of unmanned aerial vehicles (UAVs), the computer-readable medium storing instructions that, when executed by a processor, cause the processor to perform operations, the operations comprising:

partitioning, by a UAV control system, the airspace over a geographic region into a plurality of airspace regions; the UAV control system including a plurality of deconfliction controllers;

for each deconfliction controller in the plurality of deconfliction controllers, assigning to the deconfliction controller, by the UAV control system, one or more airspace regions of the plurality of airspace regions;

inputting, in parallel by the UAV control system, first flight path data for a first UAV of a plurality of UAVs to the plurality of deconfliction controllers;

processing, in parallel by the plurality of deconfliction controllers, the first flight path data to identify a flight conflict between the first UAV and one or more other UAVs; and outputting, by each deconfliction controller, a deconfliction result for the first flight path data for each airspace region.

15. The computer-readable medium of claim 14 wherein processing, in parallel by the plurality of deconfliction controllers, the first flight path data to identify a flight conflict includes:

determining, by a particular deconfliction controller of the plurality of deconfliction controllers, whether the first flight path of the first UAV conflicts with a second flight path of a second UAV within a particular airspace region assigned to the particular deconfliction controller.

16. The computer-readable medium of claim 14, wherein the computer-readable medium stores instructions that, when executed by the processor, cause the processor to perform operations comprising:

based on the deconfliction results, providing, by the UAV control system, first navigation instructions for one or more UAVs to avoid a conflict between the first UAV and a second UAV.

17. The computer-readable medium of claim 14, wherein the computer-readable medium stores instructions that, when executed by the processor, cause the processor to perform operations comprising:

based on the deconfliction results, providing, by the UAV control system, a revised flight path for one or more UAVs to avoid a conflict between the first UAV and a second UAV.

18. The method of claim 1, wherein processing, in parallel by the plurality of deconfliction controllers, the first flight path data to identify a flight conflict between the first UAV and the one or more other UAVs includes:

inputting a first deconfliction result of a first deconfliction controller of the plurality of deconfliction controllers to a second deconfliction controller of the plurality of deconfliction controllers, the first deconfliction result indicating rerouting instructions for the first UAV; and based on the rerouting instructions, assessing, by the second deconfliction controller, whether the rerouting instructions instruct the first UAV to fly a rerouted flight path that creates with another UAV, a conflict in the airspace region assigned to the second deconfliction controller.

19. The apparatus of claim 9, wherein the first flight path data is input to the plurality of deconfliction controllers over a parallel input bus.

20. The computer-readable medium of claim 14, wherein processing, in parallel by the plurality of deconfliction controllers, the first flight path data to identify a flight conflict between the first UAV and the one or more other UAVs includes:

inputting a first deconfliction result of a first deconfliction controller of the plurality of deconfliction controllers to a second deconfliction controller of the plurality of deconfliction controllers, the first deconfliction result indicating rerouting instructions for the first UAV; and based on the rerouting instructions, assessing, by the second deconfliction controller, whether the rerouting instructions instruct the first UAV to fly a rerouted flight path that creates with another UAV, a conflict in the airspace region assigned to the second deconfliction controller.

* * * * *